US005096512A

United States Patent [19]

Sagawa et al.

[11] Patent Number: 5,096,512

[45] Date of Patent: * Mar. 17, 1992

[54] MAGNETIC MATERIALS AND PERMANENT MAGNETS

[75] Inventors: Masato Sagawa, Ibaraki; Setsuo Fujimura, Kyoto; Yutaka Matsuura, Hyogo, all of Japan

[73] Assignee: Sumitomo Special Metals Co., Ltd., Osaka, Japan

[ * ] Notice: The portion of the term of this patent subsequent to Sep. 13, 2005 has been disclaimed.

[21] Appl. No.: 224,411

[22] Filed: Jul. 26, 1988

Related U.S. Application Data

[60] Division of Ser. No. 13,165, Feb. 10, 1987, Pat. No. 4,770,723, which is a continuation of Ser. No. 510,234, Jul. 1, 1983, abandoned.

[30] Foreign Application Priority Data

| | | | |
|---|---|---|---|
| Aug. 21, 1982 | [JP] | Japan | 57-145072 |
| Nov. 15, 1982 | [JP] | Japan | 57-200204 |
| Jan. 19, 1983 | [JP] | Japan | 58-5814 |
| Mar. 8, 1983 | [JP] | Japan | 58-37896 |
| Mar. 8, 1983 | [JP] | Japan | 58-37898 |
| May 14, 1983 | [JP] | Japan | 58-84859 |
| May 31, 1983 | [JP] | Japan | 58-94876 |

[51] Int. Cl.[5] ..... C22C 38/00

[52] U.S. Cl. ..... 148/302; 420/121; 420/83

[58] Field of Search ..... 420/121, 83; 148/302; 75/244, 245, 246, 251

[56] References Cited

U.S. PATENT DOCUMENTS

| | | | |
|---|---|---|---|
| 4,601,875 | 7/1986 | Yamamoto et al. | 148/302 |
| 4,663,066 | 5/1987 | Fruchart et al. | 148/302 |
| 4,684,406 | 8/1987 | Matsuura et al. | 148/302 |
| 4,721,538 | 1/1988 | Narasimhan et al. | 420/121 |
| 4,765,848 | 8/1988 | Mohri et al. | 148/302 |
| 4,770,702 | 9/1988 | Ishigaki et al. | 420/121 |
| 4,770,723 | 9/1988 | Sagawa et al. | 148/302 |
| 4,773,450 | 9/1988 | Fujimura et al. | 420/121 |
| 4,840,684 | 6/1989 | Fujimura et al. | 148/302 |

*Primary Examiner*—Deborah Yee
*Attorney, Agent, or Firm*—Fish & Richardson

[57] ABSTRACT

Magnetic materials comprising Fe, B and R (rare earth elements) having a major phase of an Fe-B-R intermetallic compound which may be a tetragonal system, wherein at least 50 at % of R consists of Nd and/or Pr, and anisotropic sintered permanent magnets consisting essentially of 8-30 at % R, 2028 at %, B and the balance being Fe with impurities. These magnetic materials and permanent magnets may contain additional elements M (Ti, Ni, Bi, V, Nb, Ta, Cr, Mo, W, Mn, Al, Sb, Ge, Sn, Zr, Hf), thus providing Fe-B-R-M type materials and magnets.

63 Claims, 13 Drawing Sheets

FIG. 8A
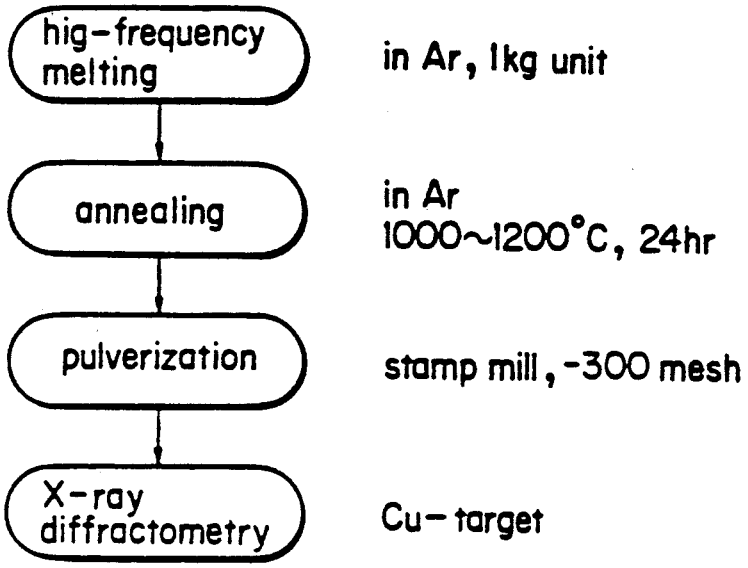
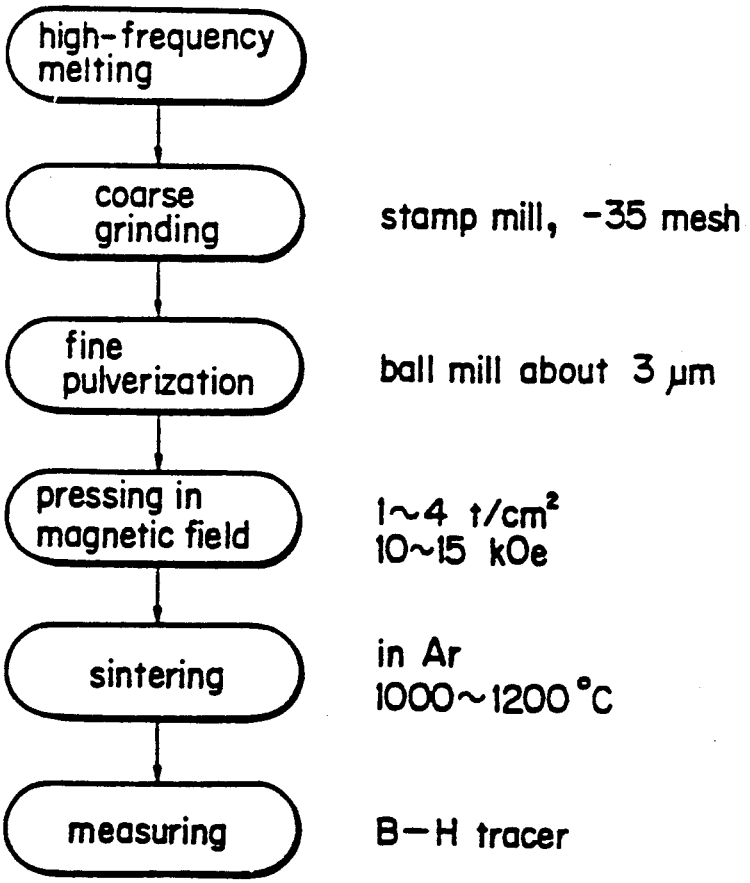
FIG. 8B

MAGNETIC MATERIALS AND PERMANENT MAGNETS

REFERENCE TO RELATED APPLICATION

This application is a division of application Ser. No. 013,165, filed Feb. 10, 1987, now U.S. Letters Pat. No. 4,770,723, which is a continuation of application Ser. No. 510,234, filed July 1, 1983, now abandoned.

FIELD OF THE INVENTION

The present invention relates to novel magnetic materials and permanent magnets prepared based on rare earth elements and iron without recourse to cobalt which is relatively rare and expensive. In the present disclosure, R denotes rare earth elements inclusive of yttrium.

BACKGROUND OF THE INVENTION

Magnetic materials and permanent magnets are one of the important electric and electronic materials applied in an extensive range from various electrical appliances for domestic use to peripheral terminal devices of large-scaled computers. In view of recent needs for miniaturization and high efficiency of electric and electronic equipment, there has been an increasing demand for upgrading of permanent magnets and in general magnetic materials.

Now, referring to the permanent magnets, typical permanent magnet materials currently in use are alnico, hard ferrite and rare earth-cobalt magnets. With a recent unstable supply of cobalt, there has been a decreasing demand for alnico magnets containing 20–30 wt % of cobalt. Instead, inexpensive hard ferrite containing iron oxides as the main component has showed up as major magnet materials. Rare earth-cobalt magnets are very expensive, since they contain 50–65 wt % of cobalt and make use of Sm that is not much found in rare earth ores. However, such magnets have often been used primarily for miniaturized magnetic circuits of high added value, because they are by much superior to other magnets in magnetic properties.

If it could be possible to use, as the main component for the rare earth elements, light rare earth elements that occur abundantly in ores without recourse to cobalt, the rare earth magnets could be used abundantly and with less expense in a wider range. In an effort made to obtain such permanent magnet materials, R-$Fe_2$ base compounds, wherein R is at least one of the rare earth metals, have been investigated. A. E. Clark has discovered that sputtered amorphous $TbFe_2$ has an energy product of 29.5 MGOe at 4.2° K., and shows a coercive force Hc=3.4 kOe and a maximum energy product (BH)Max=7 MGOe at room temperature upon heat treatment at 300°–500° C. Reportedly, similar investigations on $SmFe_2$ indicated that 9.2 MGOe was reached at 77° K. However, these materials are all obtained by sputtering in the form of thin films that cannot be generally used as magnets for, e.g., speakers or motors. It has further been reported that melt-quenched ribbons of PrFe base alloys show a coercive force Hc—as high as 2.8 kOe.

In addition, Koon et al discovered that, with melt-quenched amorphous ribbons of $(Fe_{0.82}B_{0.18})_{0.9}Tb_{0.05}La_{0.05}$, Hc of 9 kOe was reached upon annealing at 627° C. (Br=5 kG). However, (BH)max is then low due to the unsatisfactory loop squareness of magnetization curves (N. C. Koon et al, Appl. Phys. Lett. 39 (10), 1981, pp. 840–842).

Moreover, L. Kabacoff et al reported that among melt-quenched ribbons of $(Fe_{0.8}B_{0.2})_{1-x}Pr_x$ (x=0–0.03 atomic ratio), certain ones of the Fe-Pr binary system show Hc on the kilo oersted order at room temperature.

These melt-quenched ribbons or sputtered thin films are not any practical permanent magnets (bodies) that can be used as such. It would be practically impossible to obtain practical permanent magnets from these ribbons or thin films.

That is to say, no bulk permanent magnet bodies of any desired shape and size are obtainable from the conventional Fe-B-R base melt-quenched ribbons or R-Fe base sputtered thin films. Due to the unsatisfactory loop squareness (or rectangularity) of the magnetization curves, the Fe-B-R base ribbons heretofore reported are not taken as the practical permanent magnet materials comparable with the conventional, ordinary magnets. Since both the sputtered thin films and the melt-quenched ribbons are magnetically isotropic by nature, it is indeed almost impossible to obtain therefrom magnetically anisotropic (hereinbelow referred to "anisotropic") permanent magnets for the practical purpose.

SUMMARY OF THE DISCLOSURE

An essential object of the present invention is to provide novel Co-free magnetic materials and permanent magnets.

Another object of the present invention is to provide practical permanent magnets from which the aforesaid disadvantages are removed.

A further object of the present invention is to provide magnetic materials and permanent magnets showing good magnetic properties at room temperature.

A still further object of the present invention is to provide permanent magnets capable of achieving such high magnetic properties that could not be achieved by R-Co permanent magnets.

A still further object of the present invention is to provide magnetic materials and permanent magnets which can be formed into any desired shape and size.

A still further object of the present invention is to provide permanent magnets having magnetic anisotropy, good magnetic properties and excellent mechanical strength.

A still further object of the present invention is to provide magnetic materials and permanent magnets obtained by making effective use of light rare earth elements occurring abundantly in nature.

Other objects of the present invention will become apparent from the entire disclosure.

The novel magnetic materials and permanent magnets according to the present invention are essentially comprised of alloys essentially formed of novel intermetallic compounds and are substantially crystalline, said intermetallic compounds being at least characterized by their novel Curie points Tc.

According to the first embodiment of the present invention, there is provided a magnetic material which comprises as indispensable components Fe, B and R (at least one of rare earth elements inclusive of Y), and in which a major phase is formed of an intermetallic compound(s) of the Fe-B-R type having a crystal structure of the substantially tetragonal system.

According to the second embodiment of the present invention, there is provided a sintered magnetic material having a major phase formed of an intermetallic compound(s) consisting essentially of, by atomic percent, 8-30% R (at least one of rare earth elements inclusive of Y), 2-28% B and the balance being Fe with impurities.

According to the third embodiment of the present invention, there is provided a sintered magnetic material having the same composition as the second embodiment, and having a major phase formed of an intermetallic compound(s) of the substantially tetragonal system.

According to the fourth embodiment thereof, there is provided a sintered anisotropic permanent magnet consisting essentially of, by atomic percent, 8-30% R (at least one of rare earth elements inclusive of Y), 2-28% B and the balance being Fe with impurities.

The fifth embodiment thereof provides a sintered anisotropic permanent magnet having a major phase formed of an intermetallic compound(s) of the Fe-B-R type having a crystal structure of the substantially tetragonal system, and consisting essentially of, by atomic percent 8-30% R (at least one of rare earth elements inclusive of Y), 2-28% B and the balance being Fe with impurities.

"%" denotes atomic % in the present disclosure if not otherwise specified.

The magnetic materials of the 1st to 3rd embodiments according to the present invention may contain as additional components at least one of elements M selected from the group given below in the amounts of no more than the values specified below, provided that the sum of M is no more than the maximum value among the values specified below of said elements M actually added and the amount of M is more than zero:

| | | |
|---|---|---|
| 4.5% Ti, | 8.0% Ni, | 5.0% Bi, |
| 9.5% V, | 12.5% Nb, | 10.5% Ta, |
| 8.5% Cr, | 9.5% Mo, | 9.5% W, |
| 8.0% Mn, | 9.5% Al, | 2.5% Sb, |
| 7.0% Ge, | 3.5% Sn, | 5.5% Zr, |
| and 5.5% Hf. | | |

Those constitute the 6th-8th embodiments (Fe-B-R-M type) of the present invention, respectively.

The permanent magnets (the 4th and 5th embodiments) of the present invention may further contain at least one of said additional elements M selected from the group given hereinabove in the amounts of no more than the values specified hereinabove, provided that the amount of M is not zero and the sum of M is no more than the maximum value among the values specified above of said elements M actually added. These embodiments constitute the 9th and 10th embodiments (Fe-B-R-M type) of the present invention.

With respect to the inventive permanent magnets, practically useful magnetic properties are obtained when the mean crystal grain size of the intermetallic compounds is 1 to 80 μm for the Fe-B-R type, and 1 to 90 μm for the Fe-B-R-M type.

Furthermore, the inventive permanent magnets can exhibit good magnet properties by containing 1 vol % or higher of nonmagnetic intermetallic compound phases.

The inventive magnetic materials are advantageous in that they can be obtained in the form of at least as-cast alloys, or powdery or granular alloys or a sintered mass, and applied to magnetic recording media (such as magnetic recording tapes) as well as magnetic paints, temperature-sensitive materials and the like. Besides the inventive magnetic materials are useful as the intermediaries for the production of permanent magnets.

BRIEF DESCRIPTION OF THE DRAWINGS

FIGS. 8A and 8B are flow charts illustrative of the experimental procedures of powder X-ray analysis and demagnetization curve measurements.

DETAILED DESCRIPTION OF THE PREFERRED EMBODIMENTS

Figure 1:
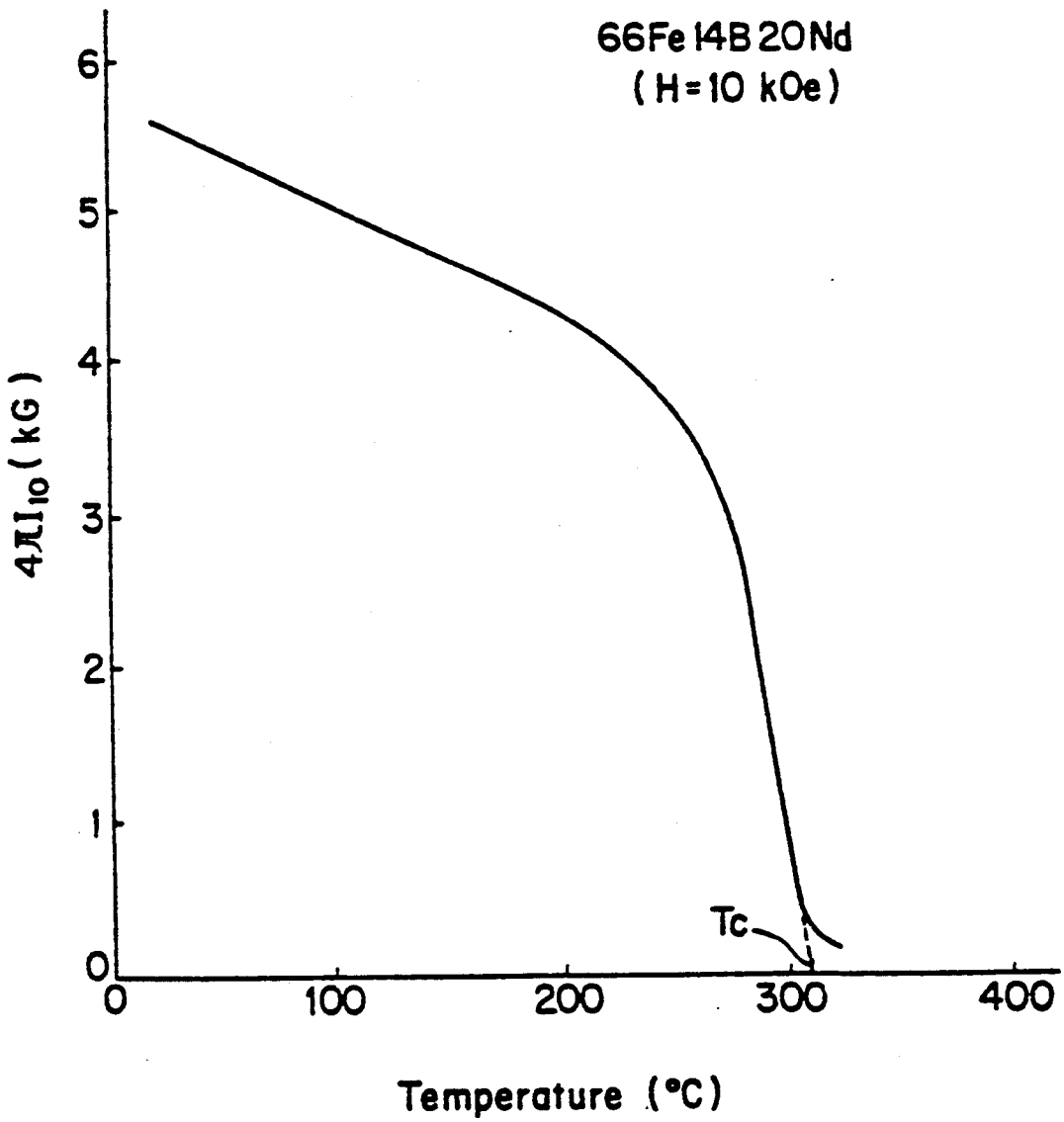
FIG. 1 is a graph showing magnetization change characteristics, depending upon temperature, of a block cut out of an ingot of an Fe-B-R alloy (66Fe-14B-20Nd) having a composition within the present invention (magnetization $4\pi I_{10}$ (kG) versus temperature °C.)

It has been noted that R-Fe base compounds provide Co-free permanent magnet materials showing large magnetic anisotropies and magnetic moments. However, it has been found that the R-Fe base compounds containing as R light rare earth elements have extremely low Curie temperatures (points), and cannot occur in a stable state. For example, $PrFe_2$, is unstable and difficulty is involved in the preparation thereof since a large amount of Pr is required. Thus, studies have been made with a view to preparing novel compounds which are stable at room or elevated temperatures and have high Curie points on the basis of R and Fe.

Based on the available results of researches, considerations have been made of the relationship between the magnetic properties and the structures of R-Fe base compounds. As a consequence, the following facts have been revealed.

(1) The interatomic distance between Fe atoms and the environment around the Fe atoms such as the number and kind of the vicinal-most atoms would play a very important role in the magnetic properties of R-Fe base compounds.

(2) With only combinations of R with Fe, no compound suitable for permanent magnets in a crystalline state would occur.

Fe-B-R ALLOYS

In view of these facts, the conclusion has been arrived at that, in the R-Fe base compounds, the presence of a third element is indispensable to alter the environment around Fe atoms and thereby attain the properties suitable for permanent magnets. With this in mind, close examinations have been made of the magnetic properties of R-Fe-X ternary compounds to which various elements were applied. As a result, R-Fe-B compounds (referred to "Fe-B-R type compounds" hereinafter) containing B as X have been discovered. It follows that the Fe-B-R type compounds are unknown compounds, and can provide excellent permanent magnet materials, since they have higher Curie points and large anisotropy constants than the conventional R-Fe compounds.

Based on this view point, a number of R-Fe base systems have been prepared to seek out novel alloys. As a result, the presence of novel Fe-B-R base compounds showing Curie points of about 300° C. has been confirmed, as illustrated in Table 1. Further, as a result of the measurement of the magnetization curves of these alloys with a superconductive magnet, it has been found that the anisotropic magnetic field reaches 100 kOe or higher. Thus, the Fe-B-R base compounds have turned out to be greatly promising for permanent magnet materials.

The Fe-B-R base alloys have been found to have a high crystal magnetic anisotropy constant Ku and an anisotropy field Ha standing comparison with that of the conventional SmCo type magnet.

PREPARATION OF PERMANENT MAGNETS

The permanent magnets according to the present invention are prepared by a so-called powder metallurgical process, i.e., sintering, and can be formed into any desired shape and size, as already mentioned. However, desired practical permanent magnets (bodies) were not obtained by such a melt-quenching process as applied in the preparation of amorphous thin film alloys, resulting in no practical coercive force at all.

On the other hand, no desired magnetic properties (particularly coercive force) were again obtained at all by melting, casting and aging used in the production of alnico magnets, etc.

In accordance with the present invention, however, practical permanent magnets (bodies) of any desired shape are obtained by forming and sintering powder alloys, which magnets have the end good magnetic properties and mechanical strength. For instance, the powder alloys are obtainable by melting, casting and grinding or pulverization.

The sintered bodies can be used in the as-sintered state as useful permanent magnets, and may of course be subjected to aging usually applied to conventional magnets.

Noteworthy in this respect is that, as is the case with $PrCo_5$, $Fe_2B$, $Fe_2P$. etc., there are a number of compounds incapable of being made into permanent magnets among those having a macro anisotropy constant, although not elucidatable. In view of the fact that any good properties suitable for the permanent magnets are not obtained until alloys have macro magnetic anisotropy and acquire a suitable microstructure, it has been found that practical permanent magnets are obtained by powdering of cast alloys followed by forming (pressing) and sintering.

Since the permanent magnets according to the present invention are based on the Fe-B-R system, they need not contain Co. In addition, the starting materials are not expensive, since it is possible to use as R light rare earth elements that occur abundantly in view of the natural resource, whereas it is not necessarily required to use Sm or to use Sm as the main component. In this respect, the invented magnets are prominently useful.

CRYSTAL GRAIN SIZE OF PERMANENT MAGNETS

According to the theory of the single domain particles, magnetic substances having high anisotropy field Ha potentially provide fine particle type magnets with high-performance as is the case with the hard ferrite or SmCo base magnets. From such a viewpoint, sintered, fine particle type magnets were prepared with wide ranges of composition and varied crystal grain size after sintering to determine the permanent magnet properties thereof.

As a consequence, it has been found that the obtained magnet properties correlate closely with the mean crystal grain size after sintering. In general, the single magnetic domain, fine particle type magnets have magnetic walls which are formed within each of the particles, if the particles are large. For this reason, inversion of magnetization easily takes place due to shifting of the magnetic walls, resulting in a low Hc. On the contrary, if the particles are reduced in size to below a certain value, no magnetic walls are formed within the particles. For this reason, the inversion of magnetization proceeds only by rotation, resulting in high Hc. The critical size defining the single magnetic domain varies depending upon diverse materials, and has been thought to be about 0.01 μm for iron, about 1 μm for hard ferrite, and about 4 μm for SmCo.

The Hc of various materials increases around their critical size. In the Fe-B-R base permanent magnets of the present embodiment, Hc of 1 kOe or higher is obtained when the mean crystal grain size ranges from 1 to 80 μm, while Hc of 4 kOe or higher is obtained in a range of 2 to 40 μm.

Figure 6:
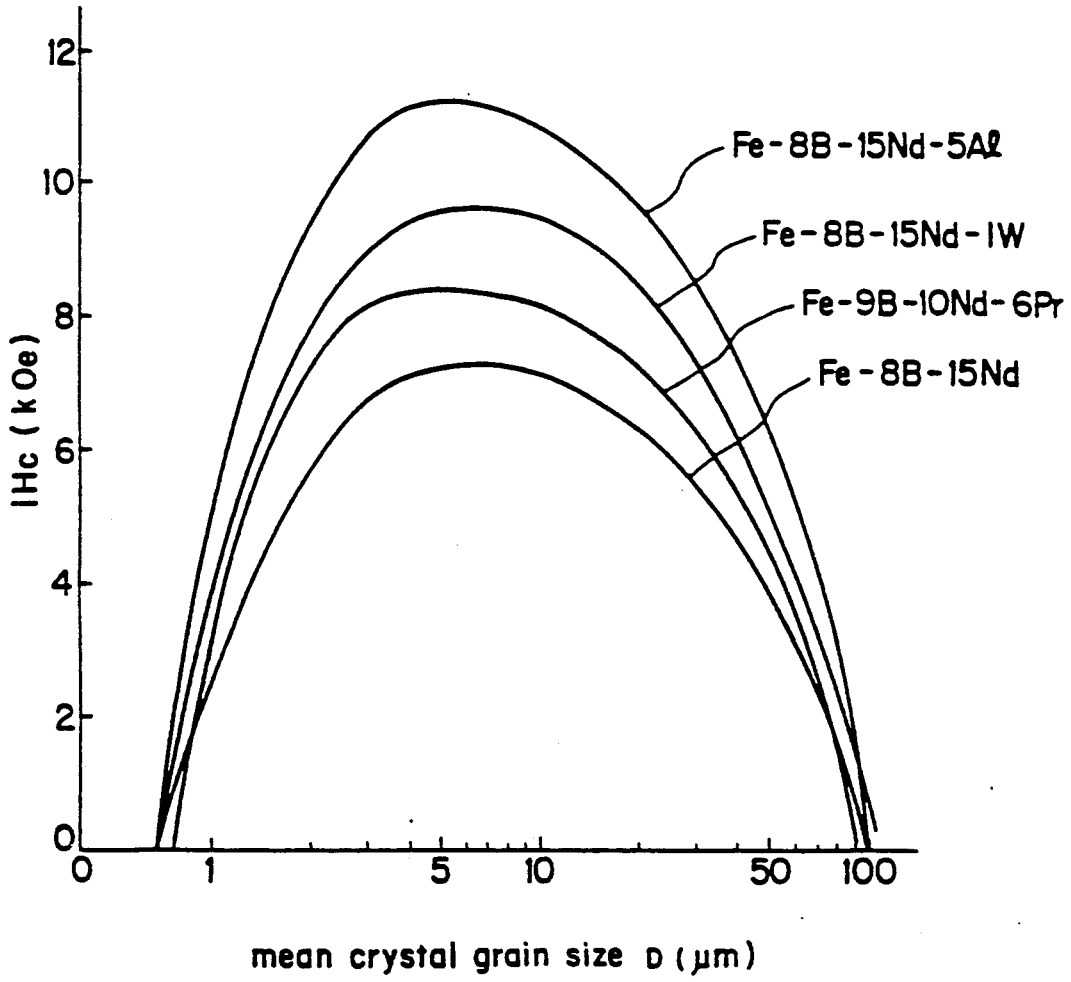
FIG. 6 is a graph depicting the relation between iHc(kOe) and the mean crystal grain size D(μm) for examples according to the present invention.

The permanent magnets according to the present invention are obtained as a sintered body, which enables production with any desired shape and size. Thus the crystal grain size of the sintered body after sintering is of primary concern. It has experimentally been ascertained that, in order to allow the Hc of the sintered compact to exceed 1 kOe, the mean crystal grain size should be no less than about 1 μm, preferably 1.5 μm, after sintering. In order to obtain sintered bodies having a smaller crystal grain size than this, still finer powders should be prepared prior to sintering. However, it is then believed that the Hc of the sintered bodies decrease considerably, since the fine powders of the Fe-B-R alloys are susceptible to oxidation, the influence of distortion applied upon the fine particles increases, superparamagnetic substances rather than ferromagnetic substances are obtained when the grain size is excessively reduced, or the like. When the crystal grain size exceeds 80 μm, the obtained particles are not single magnetic domain particles, and include magnetic walls therein, so that the inversion of magnetization easily takes place, thus leading to a drop in Hc. A grain size of no more than 80 μm is required to obtain Hc of no less than 1 kOe. Refer to FIG. 6.

With the systems incorporated with additional elements M (to be described in detail later), the compounds should have mean crystal grain size ranging from 1 to 90 μm (preferably 1.5 to 80 μm, more preferably 2 to 40 μm). Beyond this range, Hc of below 1 kOe will result.

With the permanent magnet materials, the fine particles having a high anisotropy constant are ideally separated individually from one another by nonmagnetic phases, since a high Hc is then obtained. To this end, the presence of 1 vol % or higher of nonmagnetic phases contributes to the high Hc. In order that Hc is no less than 1 kOe, the nonmagnetic phases should be present in a volume ratio of at least 1%. However, the presence of 45% or higher of the nonmagnetic phases is not preferable. A preferable range is thus 2 to 10 vol %. The nonmagnetic phases are mainly comprised of intermetallic compound phases containing much of R, while the presence of a partial oxide phase serves effectively as the nonmagnetic phases.

PREPARATION OF MAGNETIC MATERIALS

Typically, the magnetic materials of the present invention may be prepared by the process forming the previous stage of the powder metallurgical process for the preparation of the permanent magnets of the present invention. For example, various elemental metals are melted and cast into alloys having a tetragonal system crystal structure, which are then finely ground into fine powders.

For the magnetic material, use may be made of the powdery rare earth oxide $R_2O_3$ (a raw material for R). This may be heated with powdery Fe, powdery FeB and a reducing agent (Ca, etc) for direct reduction. The resultant powder alloys show a tetragonal system as well.

The powder alloys can further be sintered into magnetic materials. This is true for both the Fe-B-R base and the Fe-B-R-M base magnetic materials.

The rare earth elements used in the magnetic materials and the permanent magnets according to the present invention include light- and heavy-rare earth elements inclusive of Y, and may be applied alone or in combination. Namely, R includes Nd, Pr, La, Ce, Tb, Dy, Ho, Er, Eu, Sm, Gd, Pm, Tm, Yb, Lu and Y. Preferably, the light rare earth elements amount to no less than 50 at % of the overall rare earth elements R, and particular preference is given to Nd and Pr. More preferably Nd plus Pr amounts to no less than 50 at % of the overall R. Usually, the use of one rare earth element will suffice, but, practically, mixtures of two or more rare earth elements such as mischmetal, didymium, etc. may be used due to their ease in availability. Sm, Y, La, Ce, Gd and the like may be used in combination with other rare earth elements such as Nd, Pr, etc. These rare earth elements R are not always pure rare earth elements and, hence, may contain impurities which are inevitably entrained in the production process, as long as they are technically available.

Boron represented by B may be pure boron or ferroboron, and those containing as impurities Al, Si, C etc. may be used.

The allowable limits of typical impurities contained in the final or finished products of magnetic materials or magnets are up to 3.5, preferably 2.3, at % for Cu; up to 2.5, preferably 1.5, at % for S; up to 4.0, preferably 3.0, at % for C; up to 3.5, preferably 2.0, at % for P; and at most 1 at % for O (oxygen), with the proviso that the total amount thereof is up to 4.0, preferably 3.0, at %. Above the upper limits, no characteristic feature of 4 MGOe is obtained, so that such magnets as contemplated in the present invention are not obtained. With respect to Ca, Mg and Si, they are allowed to exist each in an amount up to about 8 at %, preferably with the proviso that their total amount shall not exceed about 8 at %. It is noted that, although Si has an effect upon increases in Curie point, its amount is preferably about 5 at % or less, since iHc decreases sharply in an amount exceeding 5 at %. In some cases, Ca and Mg may abundantly be contained in R raw materials such as commercially available neodymium or the like.

Having an as-sintered composition of 8-30 at % R, 2-28 at % B and the balance Fe with the substantially tetragonal crystal system structure and a mean crystal grain size of 1-80 μm, the permanent magnets according to the present invention have magnetic properties such as coercive force Hc of ≧1 kOe, and residual magnetic flux density Br of ≧4 kG, and provide a maximum energy product (BH)max value which is at least equivalent or superior to the hard ferrite (on the order of up to 4 MGOe).

Figure 5:
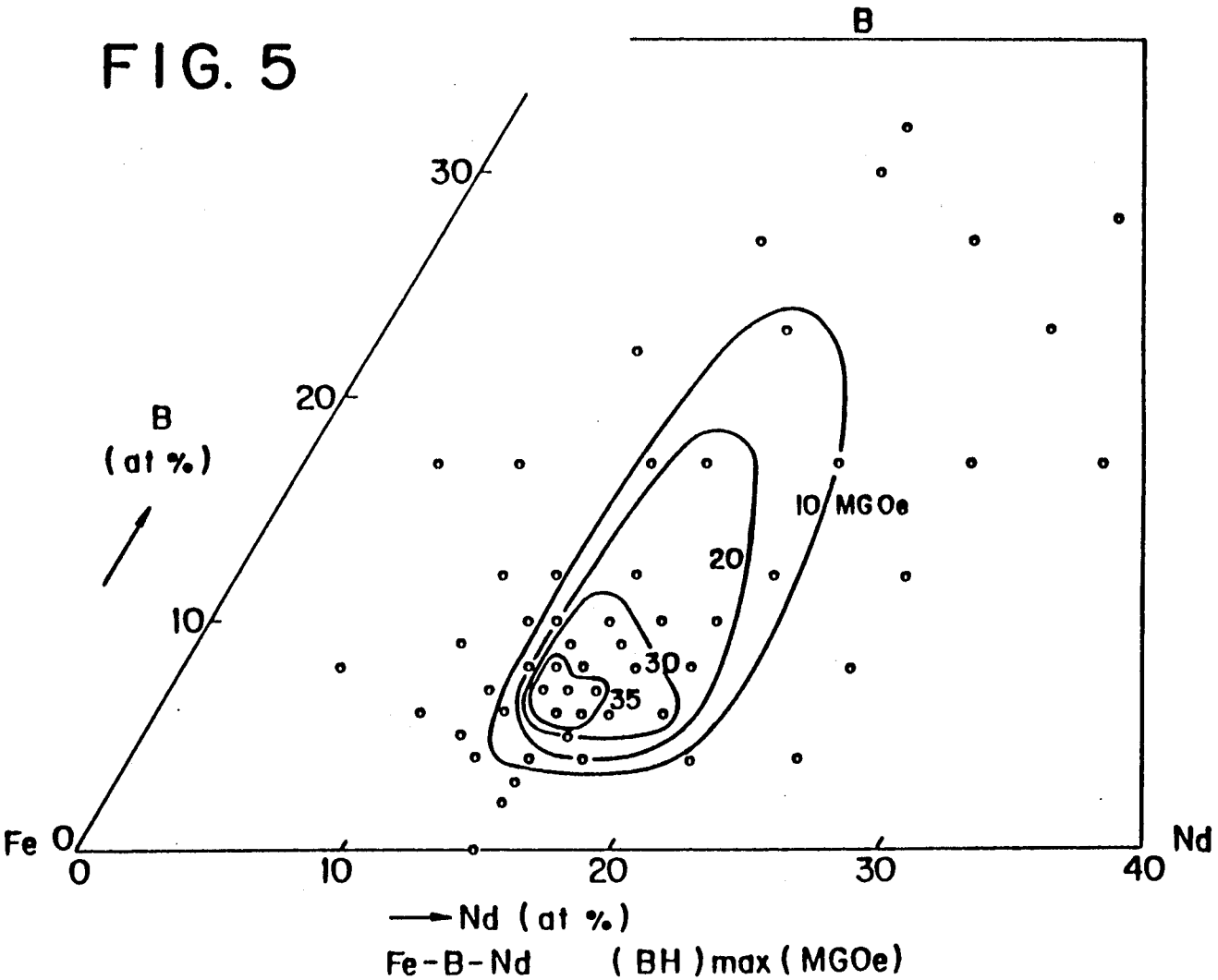
FIG. 5 is a Fe-B-Nd ternary system diagram showing compositional ranges corresponding to the maximum energy product (BH)max (MGOe)

When the light rare earth elements are mainly used as R (i.e., those elements amount to 50 at % or higher of the overall R) and a composition is applied of 12-24 at % R, 3-27 at % B with the balance being Fe, maximum energy product (BH)max of ≧7 MGOe is attained. A more preferable as-sintered composition of 12-20 at % R, 4-24 at % B with the balance being Fe, wherein Nd plus Pr amounts to 50% or higher of R provides maximum energy product (BH)max of ≧10 MGOe, and even reaches the highest value of 35 MGOe or higher. As shown in FIG. 5 as an embodiment, compositional ranges each corresponding to the (BH)max values of ≧10, ≧20, ≧30 and ≧35 MGOe are given in the Fe-B-R ternary system.

After sintering, the permanent magnet according to the present invention may be subjected to ageing and other heat treatments ordinarily applied to conventional permanent magnets, which is understood to be within the concept of the present invention.

The embodiments and effects of the present invention will now be explained with reference to the results of experiments; however, the present invention is not limited to the experiments, examples and the manner of description given hereinbelow. The present invention should be understood to encompass any modifications within the concept derivable from the entire disclosure.

Table 1 shows the magnetization $4\pi I_{16K}$, as measured at the normal temperature and 16 kOe, and Curie points Tc, as measured at 10 kOe, of various Fe-B-R type alloys. These alloys were prepared by high-frequency melting. After cooling, an ingot was cut into blocks weighing about 0.1 gram. The changes depending on temperature in $4\pi I_{10K}$ (magnetization at 10 kOe) of those blocks was measured on a vibrating sample type magnetometer (VSM) to determine their Curie points. FIG. 1 is a graphical view showing the changes depending on temperature in magnetization of the ingot of 66 Fe-14B-20Nd (sample 7 in Table 1), from which Tc is found to be 310° C.

Heretofore, there has been found no compound having Tc as shown in Table 1 among the R-Fe alloys. It has thus been found that new stable Fe-B-R type ternary compounds are obtained by adding B to the R-Fe system, and have Tc as shown in Table 1, which varies depending upon the individual R. As shown in Table 1, such new Fe-B-R type ternary compounds occur regardless of the type of R. With most of R, the new compounds have Tc on the order of about 300° C. except Ce. It is understood that the known R-Fe alloys are much lower in Tc than the Fe-B-R type ternary compounds of the present invention.

Although, in Table 1, the measured $4\pi I_{16k}$ does not show saturated magnetization due to the fact that the samples are polycrystalline, the samples all exhibit high values above 6 kOe, and are found to be effective for permanent magnet materials having increased magnetic flux densities.

TABLE 1

| Samples | Composition in atomic percent | $4\pi I_{16k}$ (kG) | Tc (°C.) |
|---|---|---|---|
| 1 | 73Fe—17B—10La | 11.8 | 320 |
| 2 | 73Fe—17B—10Ce | 7.4 | 160 |
| 3 | 73Fe—17B—10Pr | 7.5 | 300 |
| 4 | 73Fe—17B—10Sm | 9.2 | 340 |
| 5 | 73Fe—17B—10Gd | 7.5 | 330 |
| 6 | 73Fe—17B—10Tb | 6 0 | 370 |
| 7 | 66Fe—14B—20Nd | 6.2 | 310 |
| 8 | 65Fe—25B—10Nd | 6.8 | 260 |
| 9 | 73Fe—17B—5La—5Tb | 6.0 | 330 |

($4\pi I_{16k}$: $4\pi I$ measured at 16 kOe, Tc: measured at 10 kOe)

In what follows, explanation will be made to the fact that the novel compounds found in Table 1 provide high-performance permanent magnets by powder metallurgical sintering. Table 2 shows the characteristics of the permanent magnets consisting of various Fe-B-R type compounds prepared by the following steps. For the purpose of comparison, control magnets departing from the scope of the present invention are also described.

(1) Alloys were melted by high-frequency melting and cast in a water-cooled copper mold. As the starting materials for Fe, B and R, use was made of, by weight ratio for the purity, 99.9% electrolytic iron, ferroboron alloys of 19.38% B, 5.32% Al, 0.74% Si, 0.03% C and the balance Fe, and a rare earth element or elements having a purity of 99.7% or higher with the impurities being mainly other rare earth elements, respectively.

(2) Pulverization: The castings were coarsely ground in a stamp mill until they passed through a 35-mesh sieve, and then were finely pulverized in a ball mill for 3 hours to 3–10 μm.

(3) The resultant powders were oriented in a magnetic field of 10 kOe and compacted under a pressure of 1.5 t/cm$^2$.

(4) The resultant compacts were sintered at 1000°–1200° C. for about one hour in an argon atmosphere and, thereafter, allowed to cool.

As seen from Table 2, the B-free compounds have a coercive force close to zero or of so small a value that high Hc measuring meters could not be applied, and thus provide no permanent magnets. However, the addition of 4 at % or only 0.64 wt % of B raises Hc to 2.8 kOe (sample NO. 4), and there is a sharp increase in Hc with an increase in the amount of B. Incidentally, (BH)max increases to 7–20 MGOe and even reaches 35 MGOe or higher. Thus, the presently invented magnets exhibit high magnetic properties exceeding those of SmCo magnets currently known to be the highest grade magnets. Table 2 mainly shows Nd- and Pr-containing compounds but, as shown in the lower part of Table 2, the Fe-B-R type compounds wherein R stands for other rare earth elements or various combinations of rare earth elements also exhibit good permanent magnet properties.

As is the case with the samples shown in Table 2, Fe-xB-15Nd and Fe-8B-xNd systems were measured for Br and iHc. The results are summarized in FIGS. 3 and 4. Furthermore, FIG. 5 illustrates the relationship between (BH)max measured in a similar manner and the Fe-B-Nd composition in the Fe-B-R ternary system.

Figure 3:
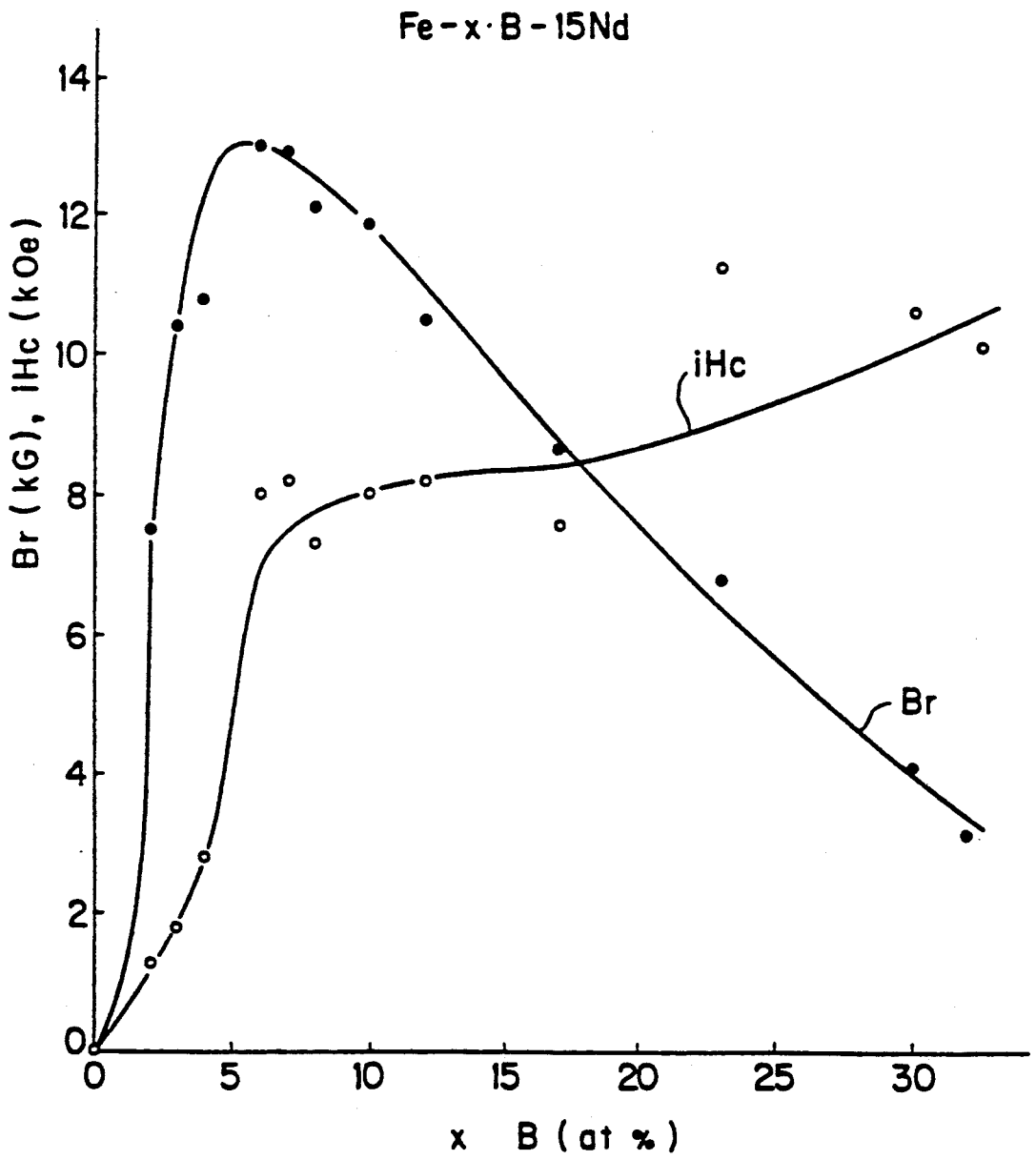
FIG. 3 is a graph showing the relation of iHc(kOe) and Br(kG) versus the B content (at %) for sintered permanent magnets of an Fe-xB-15Nd system.

The Fe-B-R type compounds exhibit good permanent magnet properties when the amounts of B and R are in a suitable range. With the Fe-B-R system, Hc increases as B increases from zero as shown in FIG. 3. On the other hand, the residual magnetic flux density Br increases rather steeply, and peaks in the vicinity of 5–7 at % B. A further increases in the amount of B causes Br to decrease.

TABLE 2-1

| No. | Composition | iHc (kOe) | Br (kG) | (BH)max MGOe |
|---|---|---|---|---|
| *1 | 85Fe—15Nd | 0 | 0 | 0 |
| 2 | 83Fe—2B—15Nd | 1.3 | 7.5 | 4.1 |
| 3 | 82Fe—3B—15Nd | 1.8 | 10.4 | 7.0 |
| 4 | 81Fe—4B—15Nd | 2.8 | 10.8 | 13.4 |
| 5 | 79Fe—6B—15Nd | 8.0 | 13.0 | 36.5 |
| 6 | 78Fe—7B—15Nd | 8.2 | 12.9 | 36.0 |
| 7 | 77Fe—8B—15Nd | 7.3 | 12.1 | 32.1 |
| 8 | 75Fe—10B—15Nd | 8.0 | 11.9 | 31.9 |
| 9 | 73Fe—12B—15Nd | 8.2 | 10.5 | 25.2 |
| 10 | 68Fe—17B—15Nd | 7.6 | 8.7 | 17.6 |
| 11 | 62Fe—23B—15Nd | 11.3 | 6.8 | 10.9 |
| 12 | 55Fe—30B—15Nd | 10.7 | 4.2 | 4.0 |
| *13 | 53Fe—32B—15Nd | 10.2 | 3.0 | 1.8 |
| 14 | 70Fe—17B—13Nd | 5.5 | 8.9 | 11.0 |
| 15 | 63Fe—17B—20Nd | 12.8 | 6.6 | 10.5 |
| 16 | 53Fe—17B—30Nd | 14.8 | 4.5 | 4.2 |
| *17 | 48Fe—17B—35Nd | >15 | 1.4 | <1 |
| 18 | 86Fe—8B—6Nd | 0 | 0 | 0 |
| 19 | 79Fe—8B—13Nd | 4.8 | 13.1 | 29.3 |
| 20 | 78Fe—8B—14Nd | 7.8 | 12.8 | 36.5 |
| 21 | 75Fe—8B—17Nd | 9.2 | 11.6 | 31.1 |
| 22 | 73Fe—8B—19Nd | 11.4 | 10.9 | 28.0 |

TABLE 2-2

| No. | Composition | iHc (kOe) | Br (kG) | (BH)max MGOe |
|---|---|---|---|---|
| 23 | 67Fe—8B—25Nd | 12.6 | 5.8 | 8.6 |
| 24 | 57Fe—8B—35Nd | 14.6 | 1.9 | ≦1 |
| 25 | 78Fe—10B—12Nd | 2.4 | 8.3 | 6.3 |
| *26 | 85Fe—15Pr | 0 | 0 | 0 |
| 27 | 73Fe—12B—15Pr | 6.8 | 9.5 | 20.3 |
| 28 | 65Fe—15B—20Pr | 12.5 | 7.1 | 10.2 |
| *29 | 76Fe—19B—5Pr | 0 | 0 | 0 |
| 30 | 76Fe—9B—15Pr | 9.0 | 11.4 | 26.9 |
| 31 | 77Fe—8B—8Nd—7Pr | 9.2 | 11.8 | 31.5 |
| 32 | 66Fe—19B—8Nd—7Ce | 5.5 | 7.1 | 10.0 |
| 33 | 74Fe—11B—2Sm—13Pr | 6.8 | 9.5 | 17.2 |
| 34 | 66Fe—19B—8Pr—7Y | 6.1 | 7.7 | 10.5 |
| 35 | 68Fe—17B—7Nd—3Pr—5La | 7.1 | 7.9 | 13.9 |
| 36 | 68Fe—20B—12Tb | 4.1 | 6.5 | 8.2 |
| 37 | 72Fe—20B—8Tb | 1.8 | 6.8 | 4.1 |
| 38 | 70Fe—10B—20Dy | 5.3 | 6.4 | 8.0 |
| 39 | 75Fe—10B—15Ho | 4.5 | 6.4 | 7.8 |
| 40 | 79Fe—8B—7Er—6Tb | 4.8 | 7.1 | 8.1 |
| 41 | 74Fe—11B—10Nd—5Ho | 10.3 | 10.1 | 23.9 |
| 42 | 68Fe—17B—8Nd—7Gd | 5.5 | 7.3 | 10.2 |
| 43 | 68Fe—17B—8Nd—7Tb | 5.7 | 7.4 | 10.8 |
| 44 | 77Fe—8B—10Nd—5Er | 5.4 | 10.6 | 25.8 |

Mark * stands for comparative samples.

In order to meet the requirement for permanent magnets (materials) to have Hc of at least 1 kOe, the amount of B should be at least 2 at % (preferably at least 3 at %).

The instantly invented permanent magnets are characterized by possessing high Br after sintering, and often suitable for uses where high magnetic flux densities are needed. In order to be equivalent or superior to the hard ferrite's Br of about 4 kG, the Fe-B-R type compounds should contain at most 28 at % B. It is understood that B ranges of 3-27 at % and 4-24 at % are preferable, or the optimum, ranges for attaining (BH)max of ≧7 MGOe and ≧10 MGOe, respectively.

The optimum amount range for R will now be considered. As shown in Table 2 and FIG. 4, the more the amount of R, the higher Hc will be. Since it is required that permanent magnet materials have Hc of no less than 1 kOe as mentioned in the foregoing, the amount of R should be 8 at % or higher for that purpose. However, the increase in the amount of R is favourable to increase Hc, but incurs a handling problem since the powders of alloys having a high R content are easy to burn owing to the fact that R is very susceptible to oxidation. In consideration of mass production, it is thus desired that the amount of R be no more than 30 at %. When the amount of R exceeds the upper limit, difficulties would be involved in mass production since alloy powders are easy to burn.

It is also desired to decrease the amount of R as much as possible, since R is more expensive than Fe. It is understood that R ranges of 12-24 at % and 12-20 at % are preferable, or the optimum, ranges for making (BH)max be ≧7 MGOe and ≧10 MGOe, respectively. Further compositional ranges for higher (BH)max values are also presented, e.g., according to FIG. 5.

Figure 4:
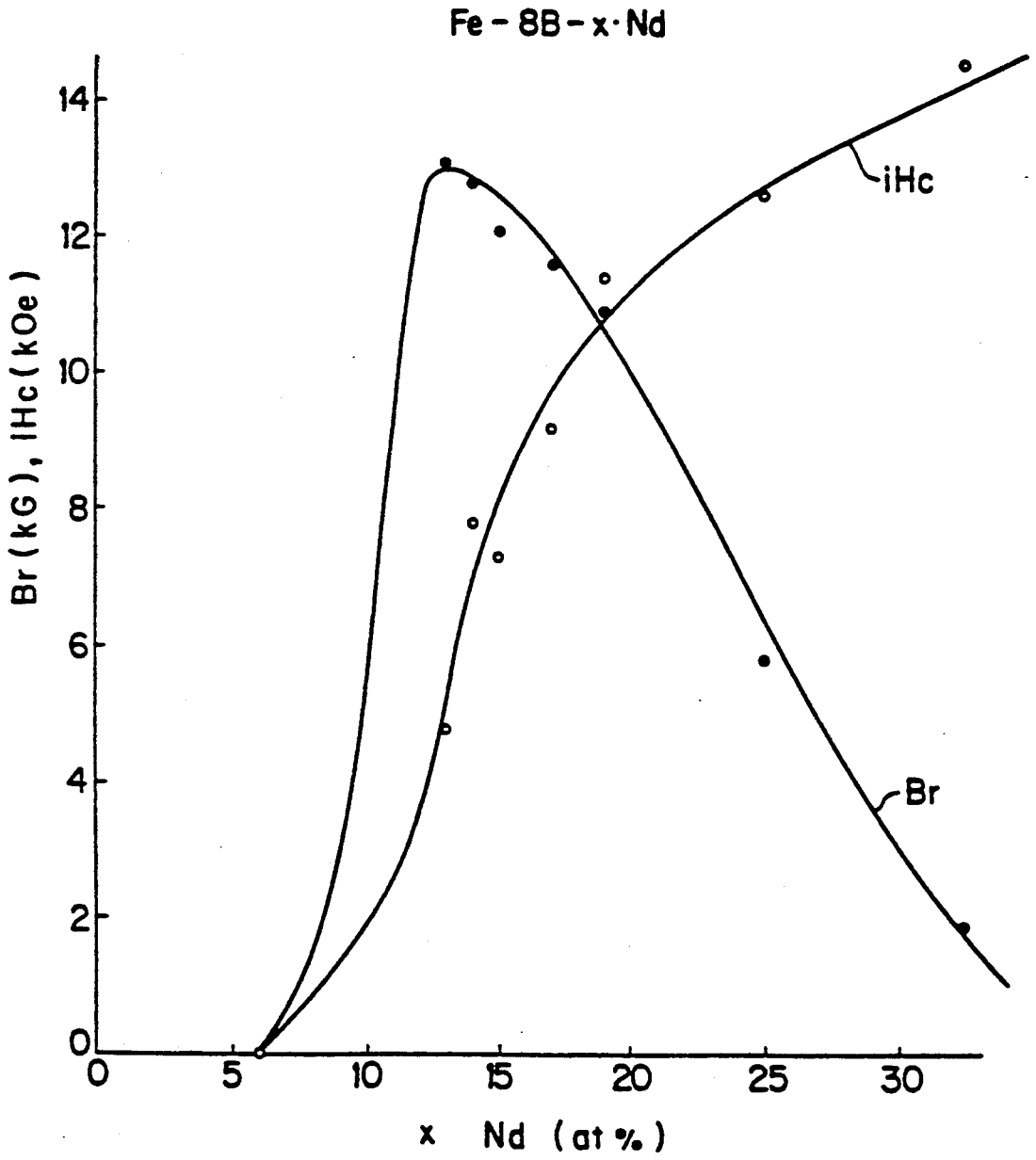
FIG. 4 is a graph showing the relation of iHc(kOe) and Br(kG) versus the Nd content (at %) for sintered permanent magnets of an Fe-8B-xNd system.

The amounts of B and R to be applied should be selected from the aforesaid ranges in such a manner that the magnetic properties as aimed at in the present invention are obtained. With the presently invented magnets, the most preferable magnetic properties are obtained when they are composed of about 8% B, about 15% R and the balance being Fe with impurities, as illustrated in FIGS. 3-5 as an embodiment.

Figure 2:
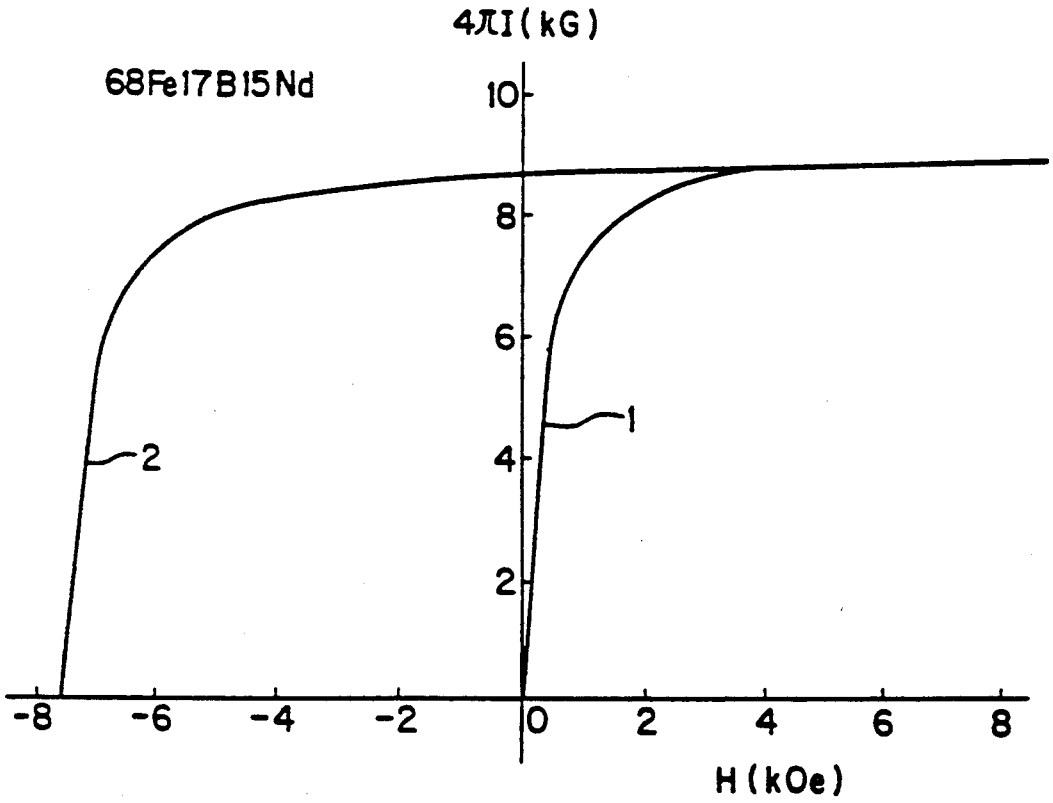
FIG. 2 is a graph showing an initial magnetization curve 1 and demagnetization curve 2 of a sintered 68Fe-17B-15Nd magnet (magnetization $4\pi I$ (kG) versus magnetic field H(kOe))

As a typical embodiment of the sintered, magnetic anisotropic magnets of the Fe-B-R system, FIG. 2 shows an initial magnetization curve 1, and a demagnetization curve 2 running through the first to the second quadrant, for 68Fe17B15Nd (having the same composition as sample No. 10 of Table 2).

The initial magnetization curve 1 rises steeply in a low magnetic field, and reaches saturation. The demagnetization curve 2 shows very high loop rectangularity. From the form of the initial magnetization curve 1, it is thought that this magnet is a so-called nucleation type permanent magnet since the SmCo type magnets of the nucleation type shows an analogous curve, wherein the coercive force of which is determined by nucleation occurring in the inverted magnetic domain. The high loop rectangularity of the demagnetization curve 2 indicates that this magnet is a typical high-performance anisotropic magnet.

Among the compounds given in Table 2, the compounds falling under the scope of the present invention, except those marked *, did all show such a tendency as illustrated in FIG. 2, viz., steep rising of the initial magnetization curve and the high rectangularity of the demagnetization curve, such high permanent magnet properties are by no means obtained by crystallization of the Fe-R or Fe-B-R type amorphous ribbons which are known in the art. There is also not known at all any conventional permanent magnet materials which possess such high properties in the absence of cobalt.

CRYSTAL GRAIN SIZE

Pulverization (2) in the experimental procedures as aforementioned was carried out for varied periods of time selected in such a manner that the measured mean particle sizes of the powder ranged from 0.5 to 100 μm, as measured with a sub-sieve-sizer manufactured by Fisher. In this manner, various samples having the compositions as specified in Table 3 were obtained.

COMPARATIVE EXAMPLES

To obtain a crystal grain size of 100 μm or greater, the sintered bodies were maintained for prolonged time in an argon atmosphere at a temperature lower than the sintering temperature by 5°-20° C.

From the thus prepared samples having the compositions as specified in Table 3 were obtained magnets which were studied to determine their magnetic properties and their mean crystal grain sizes. The mean crystal grain size referred to herein was measured in the following manner:

The samples were polished and corroded on their surfaces, and photographed through an optical microscope at a magnification ranging from ×100 to ×1000. Circles having known areas were drawn on the photographs, and divided by lines into eight equal sections. The number of grains present on the diameters were counted and averaged. However, grains on the borders (circumferences) were counted as half grains (this method is known as Heyn's method). Pores were omitted from calculation.

In Table 3, the samples marked * represent comparative examples. *1, *3, *5 and *11 all depart from the scope of the composition of the magnets according to the present invention.

From *6, *7 and *17, it is found that Hc drops to 1 kOe or less when the crystal grain size departs from the scope as defined in the present invention.

TABLE 3

| No. | Composition | Mean crystal grain size D(μm) | Magnetic Properties iHc (kOe) | Br (kG) | (BH)max (MGOe) |
|---|---|---|---|---|---|
| *1 | 80Fe—20Nd | 15 | 0 | 0 | 0 |
| 2 | 65Fe—15B—20Nd | 17 | 11.4 | 7.2 | 11.0 |
| *3 | 53Fe—32B—15Nd | 10 | 11.0 | 2.5 | 1.3 |
| 4 | 77Fe—8B—15Nd | 33 | 5.2 | 11.0 | 22.0 |
| *5 | 48Fe—17B—35Nd | 4 | ≧15 | 1.4 | ≦1 |
| *6 | 73Fe—10B—17Nd | 0.7 | <1 | 5.0 | <1 |
| *7 | 82Fe—5B—13Nd | 140 | <1 | 6.3 | 2.2 |
| 8 | 79Fe—6B—15Nd | 5 | 8.0 | 13.0 | 36.5 |
| 9 | 68Fe—17B—15Pr | 22 | 5.8 | 11.7 | 21.3 |
| 10 | 77Fe—8B—15Pr | 4 | 9.0 | 11.4 | 26.9 |
| *11 | 78Fe—17B—5Pr | 3.5 | 0 | 0 | 0 |
| 12 | 75Fe—12B—13Pr | 7 | 5.4 | 7.8 | 13.5 |
| 13 | 79Fe—6B—10Nd—5Pr | 4 | 6.6 | 10.7 | 20.1 |
| 14 | 71Fe—12B—12Nd—5Gd | 8 | 4.8 | 7.8 | 11.5 |
| 15 | 75Fe—9B—10Nd—6Pr | 3 | 8.2 | 12.0 | 31.5 |
| 16 | 77Fe—8B—9Nd—6Ce | 6 | 5.7 | 10.7 | 22.4 |
| *17 | 74Fe—11B—7Sm—8Pr | 93 | ≦1 | 4.8 | ≦1 |
| 18 | 74Fe—11B—5Ho—10Nd | 4 | 10.3 | 10.1 | 23.9 |

(*): reference samples

A sample having the same composition as No. 4 given in Table 3 and other samples were studied in detail in respect of the relationship between their mean crystal grain size D and Hc. The results are illustrated in FIG. 6, from which it is found that Hc peaks when D is approximately in a range of 3-10 μm, decreases steeply when D is below that range, and drops moderately when D is above that range. Even when the composition varies within the scope as defined in the present invention, the relationship between the average crystal grain size D and Hc is substantially maintained. This indicates that the Fe-B-R system magnets are the single domain-particulate type magnets.

Apart from the foregoing samples, an alloy having the same composition as Sample No. 8 of Table 3 was prepared by high-frequency melting and casting in a water cooled copper mold. However, the thus cast alloy had Hc of less than 1 kOe in spite of its mean crystal grain size being in a range of 20–80 μm.

From the results given in Table 3 and FIGS. 3, 4 and 6, it is evident that, in order for the Fe-B-R system magnets to possess Br of about 4 kG of hard ferrite or more and Hc of no less than 1 kOe, the composition comes within the range as defined in the present invention and the mean crystal grain size is 1–80 μm, and that, in order to obtain Hc of no less than 4 kOe, the mean crystal grain size should be in a range of 2–40 μm.

Figure 7:
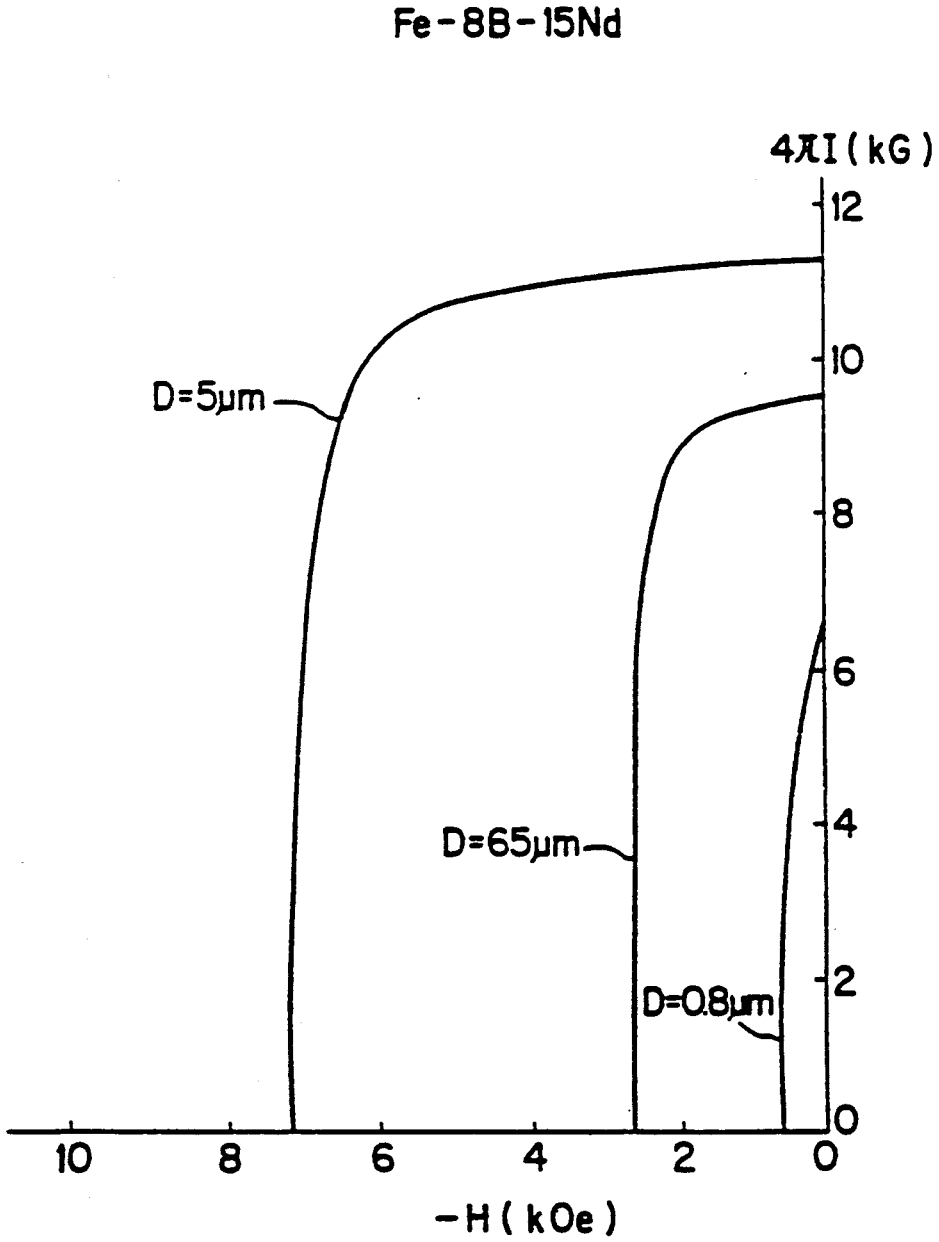
FIG. 7 is a graph showing the change of the demagnetization curves depending upon the mean crystal grain size, as observed in the example of a typical composition according to the present invention.

FIG. 7 shows demagnetization characteristic curves of sample No. 4—77Fe-8B-15Nd—given in Table 3 and FIG. 6 in respect of its typical mean crystal grain sizes (D=0.8, 5 and 65 μm). From this, it is found that the magnets having mean crystal grain size belonging to the scope as defined in the present invention possess high Hc and excellent rectangularity in the second quadrant.

Control of the crystal grain size of the sintered compact can be caried out by controlling process conditions such as pulverization, sintering, post heat treatment, etc.

CRYSTAL STRUCTURE

It is believed that the magnetic material and permanent magnets based on the Fe-B-R alloy according to the present invention can satisfactorily exhibit their own magnetic properties due to the fact that the major phase is formed by the substantially tetragonal crystals of the Fe-B-R type. As already discussed, the Fe-B-R type alloy is a novel alloy in view of its Curie point. As will be discussed hereinafter, it has further been experimentally ascertained that the presence of the substantially tetragonal crystals of the Fe-B-R type contributes to the exhibition of magnetic properties. The Fe-B-R base tetragonal system alloy is unknown in the art, and serves to provide a vital guiding principle for the production of magnetic materials and permanent magnets having high magnetic properties as aimed at in the present invention.

The crystal structure of the Fe-B-R type alloys according to the present invention will now be elucidated with reference to the following experiments.

EXPERIMENTAL PROCEDURES (1) Starting Materials (Purity is given by weight %)

Fe: Electrolytic Iron 99.9%

B: Ferroboron, or B having a purity of 99%

R: 99.7% or higher with impurities being mainly other rare earth elements (2) The experimental procedures are shown in FIG. 8.

Figure 9:
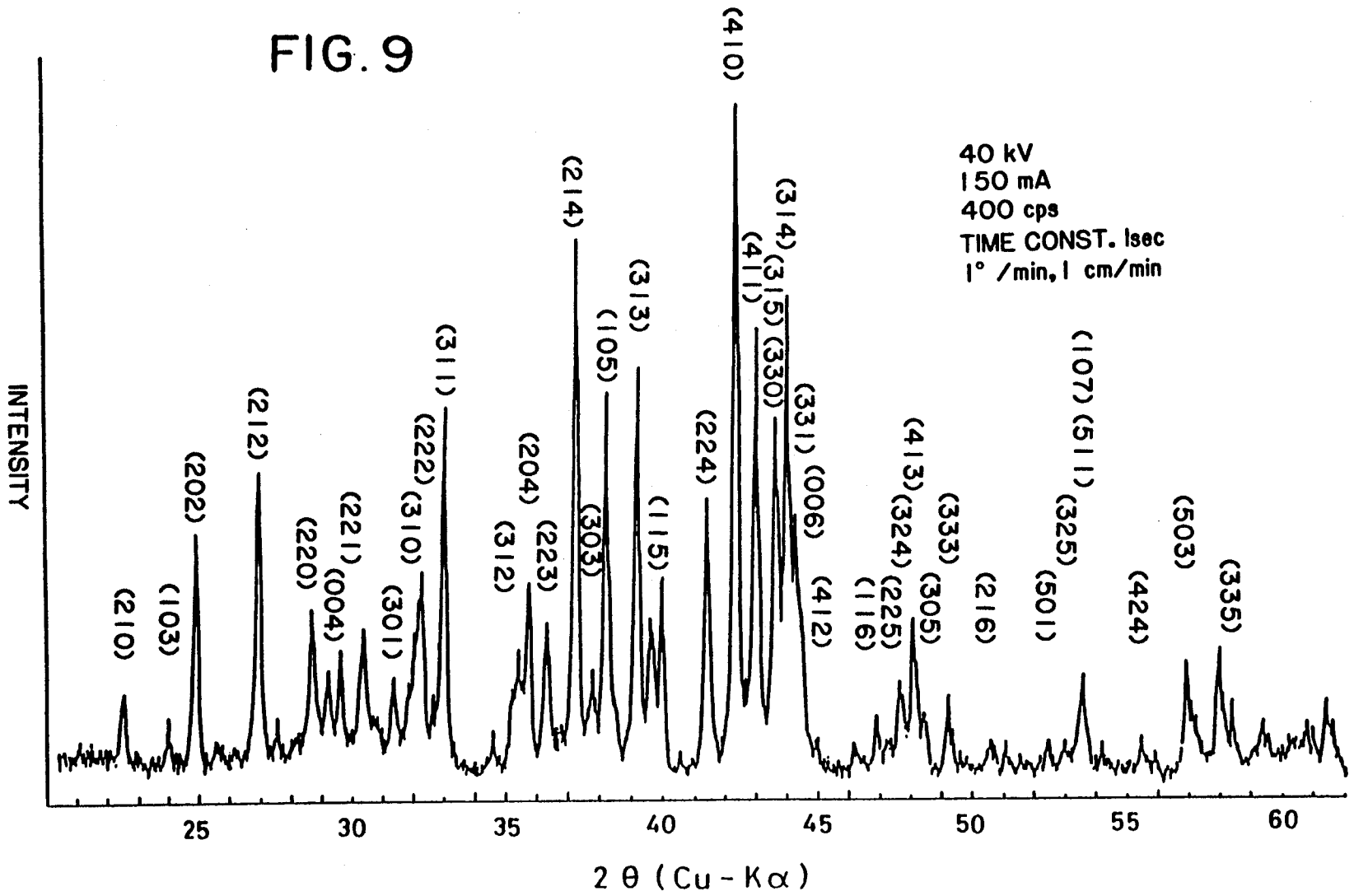
FIG. 9 is an X-ray diffraction pattern of the results measured of a typical Fe-B-R sintered body according to the present invention with an X-ray diffractometer.

The experimental results obtained are illustrated as below:

(1) FIG. 9 illustrates a typical X-ray diffractometric pattern of the Fe-B-Nd (77Fe-15Nd-8B in at %) sintered body showing high properties as measured with a powder X-ray diffractometer. This pattern is very complicated, and can not be explained by any R-Fe, Fe-B or R-B type compounds developed yet in the art.

(2) XMA measurement of the sintered body of (1) hereinabove under test has indicated that it comprises three or four phases. The major phase simultaneously contains Fe, B and R, the second phase is a R-concentrated phase having a R content of 70 weight % or higher, and the third phase is an Fe-concentrated phase having an Fe content of 80 weight % or higher. The fourth phase is a phase of oxides.

(3) As a result of analysis of the pattern given in FIG. 9, the sharp peaks included in this pattern may all be explained as the tetragonal crystals of $\alpha o = 8.8$ Å and Co=12.23 Å). In FIG. 9, indices are given at the respective X-ray peaks, The major phase simultaneously containing Fe, B and R, as confirmed in the XMA measurement, has turned out to exhibit such a structure. This structure is characterized by its extremely large lattice constants. No tetragonal system compounds having such large lattice constants are found in any one of the binary system compounds such as R-Fe, Fe-B and B-R.

(4) Fe-B-R base permanent magnets having various compositions and prepared by the aforesaid manner as well as other various manners were examined with an X-ray diffractometer, XMA and optical microscopy. As a result, the following matters have turned out:

(i) Where a tetragonal system compound having macro unit cells occurs, which contains as the essential components R, Fe and B and has lattice constants $\alpha_o$ of about 8 Å and $C_o$ of about 12 Å, good properties suitable for permanent magnets are obtained. Table 4 shows the lattice constants of tetragonal system compounds which constitute the major phase of typical Fe-B-R type magnets, i.e., occupy 50 vol% or more of the crystal structure.

In the compounds based on the conventional binary system, compounds such as R-Fe, Fe-B and B-R, it is thought that no tetragonal system compounds having such macro unit cells as mentioned above occur. It is thus presumed that no good permanent magnet properties are achieved by those known compounds.

(ii) Where said tetragonal system compound has a suitable crystal grain size and, besides, nonmagnetic phases occur which contain much R, good properties suitable for permanent magnets are obtained.

TABLE 4

Crystal structure of various Fe—B—R type compounds

| No. | Alloy composition | Structure of Major Phase (system) | Lattice constants of Major Phase $\alpha_o$ (Å) | Co (Å) |
|---|---|---|---|---|
| 1 | Fe—15Ce—8B | tetragonal | 8.77 | 12.16 |
| 2 | Fe—15Pr—8B | " | 8.84 | 12.30 |
| 3 | Fe—15Nd—8B | " | 8.80 | 12.23 |
| 4 | Fe—15Sm—8B | " | 8.83 | 12.25 |
| 5 | Fe—10Nd—5Dy—8B | " | 8.82 | 12.22 |
| 6 | Fe—10Nd—5Gd—8B | " | 8.81 | 12.20 |
| 7 | Fe—10Nd—5Er—8B | " | 8.80 | 12.16 |
| 8 | Fe—10Nd—5Ho—8B | " | 8.82 | 12.17 |
| 9 | Fe—15Nd—3B | " | 8.81 | 12.30 |
| 10 | Fe—15Nd—17B | " | 8.80 | 12.28 |
| 11 | Fe—12Nd—8B | " | 8.82 | 12.26 |
| 12 | Fe—20Nd—8B | " | 8.81 | 12.24 |
| 13 | Fe—15Nd—8B—1Ti | " | 8.80 | 12.24 |
| 14 | Fe—15Nd—8B—2Mo | " | 8.82 | 12.25 |
| 15 | Fe—15Nd—8B—1Cr | " | 8.80 | 12.23 |
| 16 | Fe—15Nd—8B—3Si | " | 8.79 | 12.22 |
| 17 | Fe—15Nd—8B—2Al | " | 8.79 | 12.22 |
| 18 | Fe—15Nd—8B—1Nb | " | 8.82 | 12.25 |
| 19 | Fe—15Nd—8B—1Sb | " | 8.81 | 12.23 |
| 20 | Fe—15Nd—8B—1Bi | " | 8.82 | 12.25 |
| 21 | Fe—15Nd—8B—1Sn | " | 8.80 | 12.23 |

TABLE 4-continued

Crystal structure of various Fe—B—R type compounds

| No. | Alloy composition | Structure of Major Phase (system) | Lattice constants of Major Phase $a_o$ (Å) | Co (Å) |
|---|---|---|---|---|
| 22 | Fe—6Nd—6B | body-centered cubic | 2.87 | — |
| 23 | Fe—15Nd—2B | rhombohedral | 8.60* | 12.50* |

N.B.: (*) indicated as hexagonal (iii) The said Fe-B-R tetragonal system compounds are present in a wide compositional range, and may be present in a stable state upon addition of certain elements other than R, Fe and B.

The said Fe-B-R intermetallic compounds have an angle of 90° between a, b and c axes within the tolerance of measurement in most cases, wherein $a_o = b_o \neq c_o$, thus these compounds being tetragonal.

In the present invention, the Fe-B-R type tetragonal crystal may be substantially tetragonal for producing the desired magnetic properties. The term "substantially tetragonal" encompasses ones that have a slightly deflected angle between a, b and c axes, i.e., within 1°, or ones that have $a_o$ slightly different from $b_o$, i.e., within 0.1%.

The Fe-B-R type permanent magnets of the tetragonal system according to the present invention will now be explained with reference to the following non-restrictive examples. EXAMPLE 1

An alloy of 8 at % B, 16 at % Pr and the balance Fe was pulverized to prepare powders having an average particle size of 15 μm. The powders were compacted under a pressure of 2 t/cm$^2$ and in a magnetic field of 10 kOe, and the resultant compact was sintered at 1090° C. for 1 hour in argon of $2\times 10^{-1}$ Torr.

X-ray diffraction has indicated that the major phase of the sintered body is a tetragonal system compound with lattice constants $a_o$=8.85 Å and Co=12.26 Å. As a consequence of XMA and optical microscopy, it has been found that the major phase contains simultaneously Fe, B and Pr, which amount to 90 volume % thereof. Nonmagnetic compound phases having a R content of no less than 80% assumed 3% of the overall material with the remainder being oxides and pores. The mean crystal grain size was 25 μm.

The magnetic properties measured are: Br=9.9 kG, iHc =6.5 kOe, and (BH)max=18 MGOe, and are by far higher than those of the conventional amorphous ribbon. EXAMPLE 2

An alloy of 8 at % B, 15 at % Nd and the balance Fe was pulverized to prepare powders having an average particle size of 3 μm. The powders were compacted in a magnetic field of 10 kOe under a pressure of 2 t/cm$^2$, and sintered at 1100° C. for 1 hour in argon of $2\times 10$ Torr.

X-ray diffraction has indicated that the major phase of the sintered compact is a tetragonal compound with lattice constants $a_o$=8.80 Å and Co=12.23 Å. As a consequence of XMA and optical microscopy, it has been found that the major phase contains simultaneously Fe, B and Nd, which amount to 90.5 volume % thereof. Nonmagnetic compound phases having a R content of no less than 80% were 4% with the remainder being virtually oxides and pores. The mean crystal grain size was 15 μm.

The magnetic properties measured are: Br=12.1 kG. iHc =7.8 kOe and (BH)max=34 MGOe, and are much higher than those the conventional amorphous ribbon.

Fe-B-R-M TYPE ALLOYS CONTAINING ADDITIONAL ELEMENTS M

According to the present invention, additional elements M can be applied to the magnetic materials and permanent magnets of the Fe-B-R type, the additional elements M including Ti, Ni, Bi, V, Nb, Ta, Cr, Mo, W, Mn, Al, Sb, Ge, Sn, Zr and Hf, which provides further magnetic materials and permanent magnets of the Fe-B-R-M system. Limitation is of course imposed upon the amount of these elements. The addition of these elements contribute to the increase in Hc compared with the Fe-R-B ternary system compounds. Among others, W, Mo, V, Al and Nb have a great effect in this respect. However, the addition of these elements incurs a reduction of Br and, hence, their total amounts should be controlled depending upon the requisite properties.

In accordance with the present invention, the amounts of these elements are respectively limited to no more than the values specified hereinbelow by atomic percent:

| | | |
|---|---|---|
| 4.5% Ti, | 8.0% Ni, | 5.0% Bi, |
| 9.5% V, | 12.5% Nb, | 10.5% Ta, |
| 8.5% Cr, | 9.5% Mo, | 9.5% W, |
| 8.0% Mn, | 9.5% Al, | 2.5% Sb, |
| 7.0% Ge, | 3.5% Sn, | 5.5% Zr, |
| and 5.5% Hf | | |

wherein, when two or more of M are applied, the total amount of M shall be no more than the maximum value among the values specified hereinabove of the M actually added.

With respect to the permanent magnets, an increase in iHc due to the addition of M results in increased stability and wide applicability of the magnets. However, the greater the amount of M, the lower the Br and (BH)max will be, due to the fact that they are nonmagnetic elements (except Ni). For this reason, the addition of M is useful provided that (BH)max is at least 4 MGOe.

To ascertain the effect of M upon Br, Br was measured in varied amounts of M. The results are summarized in FIGS. 10 to 12. As seen from FIGS. 10 to 12, the upper limits of the additional elements M (Ti, Zr, Hf, V, Ta, Nb, Cr, W, Mo, Sb, Sn, Ge and Al) other than Bi, Ni, and Mn may be chosen such that Br is at least equivalent to about 4 kG of hard ferrite. A preferable range in view of Br should be appreciated from FIGS. 10 to 12 by defining the Br range into 6.5 kG, 8 kG, 10 kG or the like stages.

Based on these figures, the upper limits of the amounts of additional elements M have been put upon the aforesaid values at or below which (BH)max is at least equivalent or superior to about 4 MGOe of hard ferrite.

Figure 10:
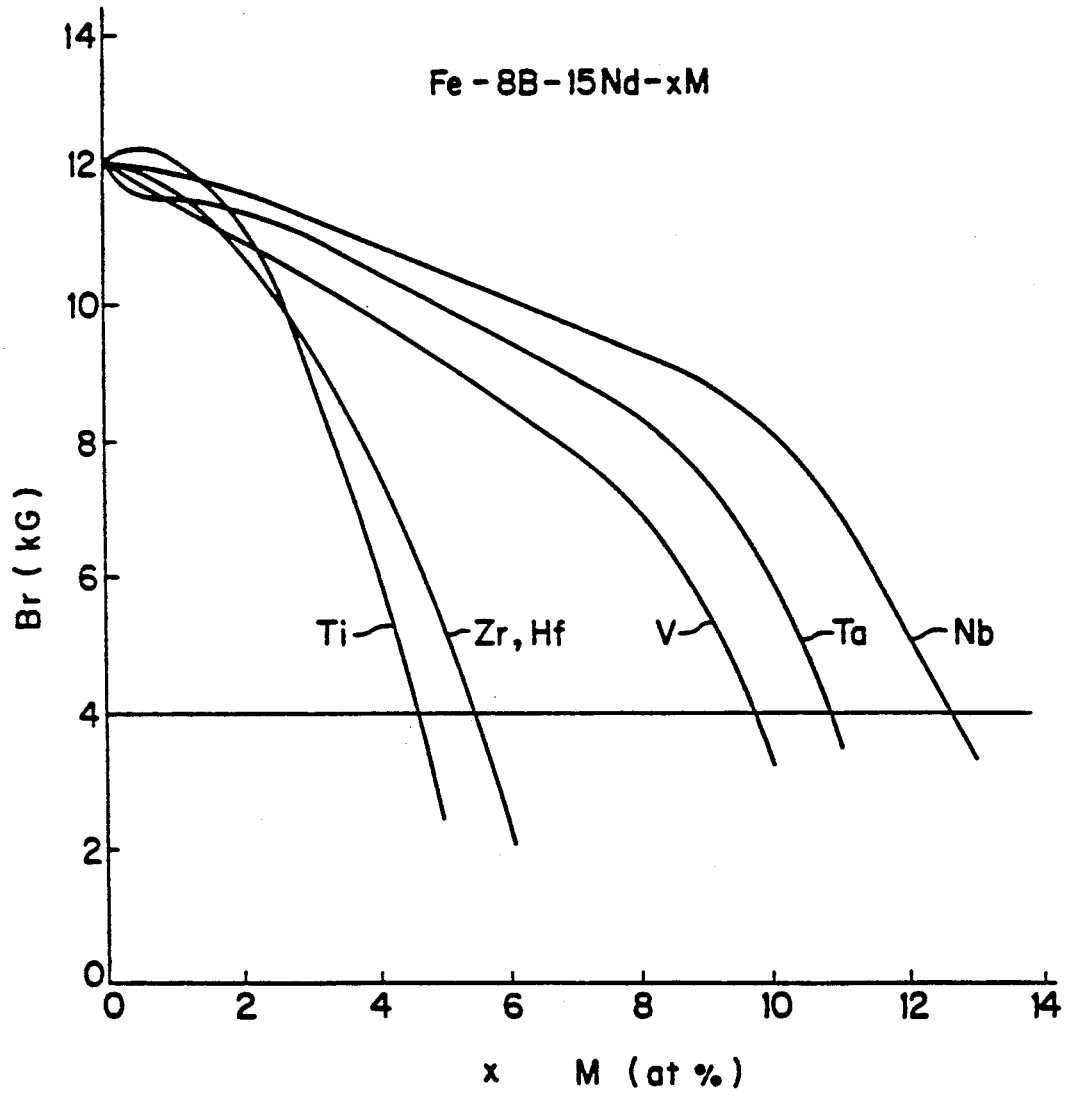
FIGS. 10-12 are graphs showing the relation of Br(kG) versus the amounts of the additional elements M (at %) for sintered Fe-8B-15Nd-xM systems.
Figure 11:
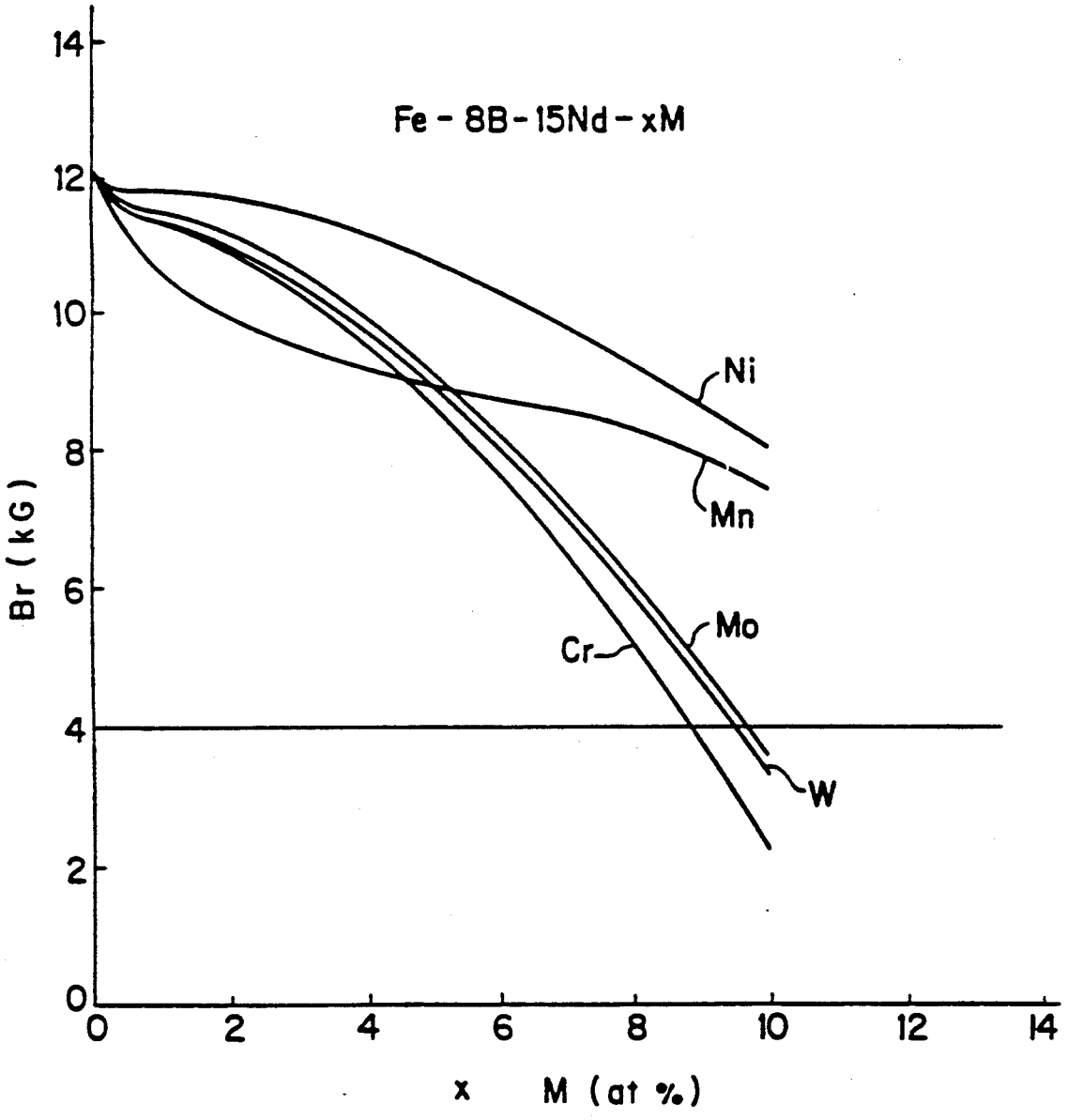
Figure 12:
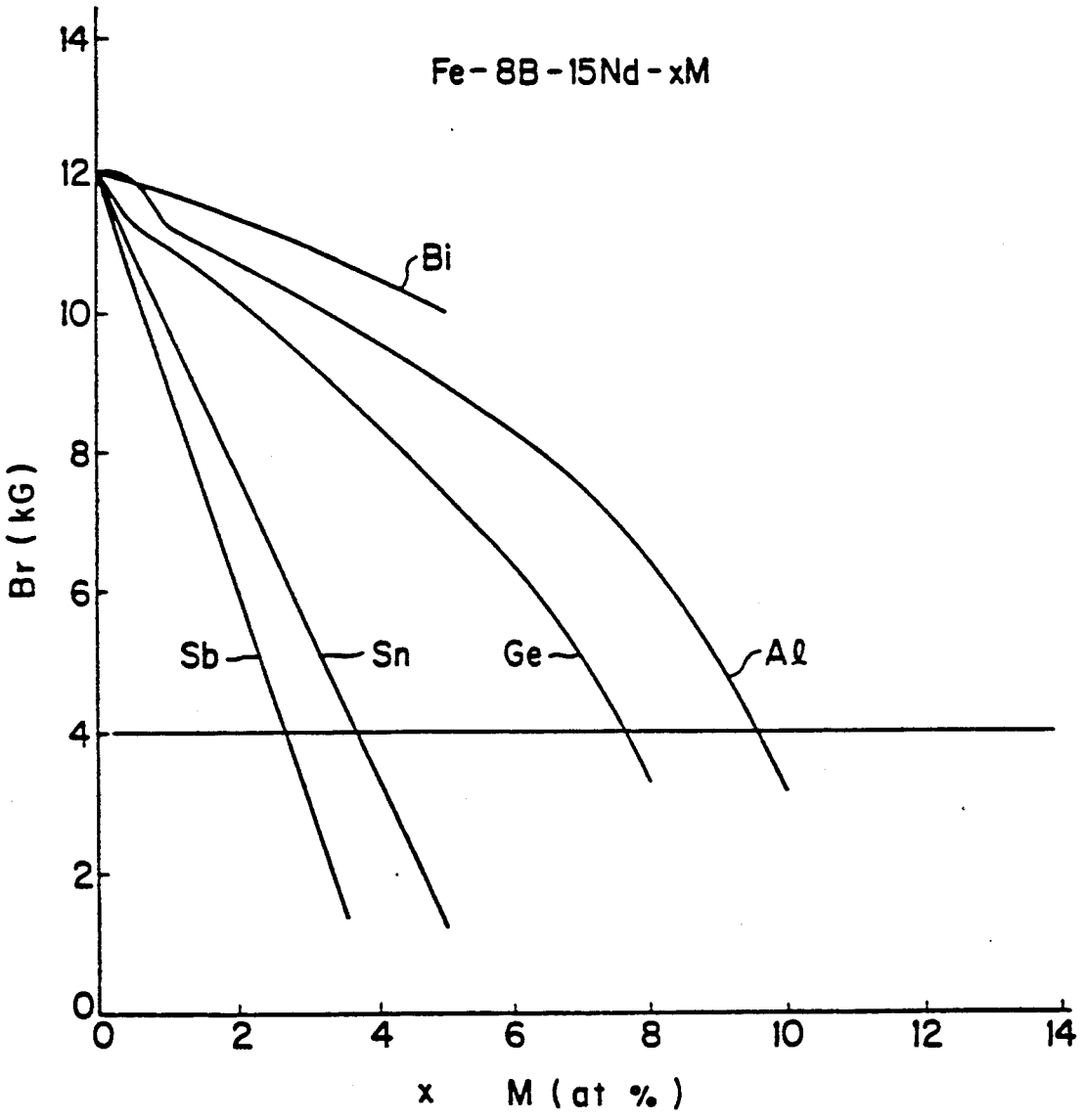

When two or more elements M are employed, the resulting characteristic curve will be depicted between the characteristic curves of the individual elements in FIGS. 10 to 12. Thus the amounts of the individual elements M are within the aforesaid ranges, and the total amount thereof is no more than the maximum values allowed for the individual elements which are actually added and present. For example, if Ti and V are present, the total amount of Ti plus V allowed is 9.5 at %, wherein Ti≦4.5 at % and V≦9.5 at % can be used.

A composition comprised of 12–24% R, 3–27% B and the balance being (Fe+M) is preferred for providing (BH)max ≧7 MGOe.

More preferred is a composition comprised of 12–20% R, 4–24% B and the balance being (Fe+M) for providing (BH)max≧10 MGOe wherein (BH)max achieves maximum values of 35 MGOe or higher. Still more preferred compositional ranges are defined principally on the same basis as is the case in the Fe-B-R ternary system.

In general, the more the amount of M, the lower the Br; however, most elements of M serve to increase iHc. Thus, (BH)max assumes a value practically similar to that obtained with the case where no M is applied, through the addition of an appropriate amount of M. The increase in coercive force serves to stabilize the magnetic properties, so that permanent magnets are obtained which are practically very stable and have a high energy product.

If a large amount of Mn and Ni are incorporated, iHc will decrease; there is only slight decrease in Br due to the fact that Ni is a ferromagnetic element. Therefore, the upper limit of Ni is 8%, preferably 4.5%, in view of Hc.

The effect of Mn upon decrease in Br is not strong but larger than is the case with Ni. Thus, the upper limit of Mn is 8%, preferably 3.5%, in view of iHc.

With respect to Bi, its upper limit shall be 5%, since any alloys having a Bi content exceeding 5% cannot practically be produced due to extremely high vapor pressure.

In what follows, Fe-B-R-M alloys containing various additional elements M will be explained in detail with reference to their experiments and examples.

Permanent magnet materials were prepared in the following manner.

(1) Alloys were prepared by high-frequency melting and cast in a copper mold cooled with water. As the starting Fe, B and R, use was made of electrolytic iron having a purity of 99.9% (by weight % so far as the purity is concerned), ferroboron alloys or 99% pure boron, and a rare earth element(s) having a purity of no less than 99.7% (and) containing impurities mainly comprising other rare earth metals). The additional elements applied were Ti, Mo, Bi, Mn, Sb, Ni and Ta, those having a purity of 99%, W having a purity of 98%, Al having a purity of 99.9%, Hf having a purity of 95%, and Cu having a purity of 99.9%. As V ferrovanadium containing 81.2% of V; as Nb ferroniobium containing 67.6% of Nb; as Cr ferrochromium containing 61.9% of Cr; and as Zr ferrozirconium containing 75.5% of Zr were used, respectively.

(2) The resultant as-cast alloys were coarsely ground in a stamp mill until they passed through a 35-mesh sieve and, subsequently, finely pulverized to 3–10 μm for 3 hours in a ball mill.

(3) The resultant particles were oriented in a magnetic field (10 kOe) and compacted under a pressure of (1.5 t/cm$^2$).

(4) The resultant compacted bodies were sintered at 1000°–1200° C. for 1 hour in argon and, thereafter, allowed to cool.

The thus sintered compacts were measured on their iHc, Br and (BH)max, and the results of typical compacts out of these are shown in Table 5 and Table 6. The samples marked * in Table 6 represent comparative samples. In Tables 5 and 6, Fe is of course the remainder, although not specified quantitatively.

The results have revealed the following facts. Table 5-1 elucidates the effect of the additional elements M in the Fe-8B-15Nd system wherein neodymium is employed, Nd being a typical light-rare earth element. As a result, all the samples (Nos. 1 to 36 inclusive) according to the present embodiment are found to exhibit high coercive force (iHc greater than about 8.0 kOe), compared with sample 1 (iHc-7.3 kOe) given in Table 6. Among others, samples Nos. 31 and 36 possess coercive force of 15 kOe or higher. On the other hand, the samples containing a small amount of M are found to be substantially equivalent to those containing no M with respect to Br see Table 6, sample 1 (12.1 kG). It is found that there is a gradual decrease in Br with the increase in the amount of M. However, all the samples given in Table 5 have a residual magnetic flux density considerably higher than about 4 kG of the conventional hard ferrite.

In the permanent magnets of the present invention, the additional elements M are found to be effective for all the Fe-B-R ternary systems wherein R ranges from 8 to 30 at %, B ranges from 2 to 28 at %, with the balance being Fe. When B and R depart from the aforesaid ranges, the elements M are ineffective (*12, *13-R is too low -, *14-B is in excess excess-, *15-R is in excess, and *8-*11-is without B-).

To elucidate the effect of the addition of the additional elements M, changes in Br were measured in varied amounts of M according to the same testing manner as hereinabove mentioned. The results are summarized in FIG. 10 –12 which illustrate that the upper limits of the amounts of the additional elements M are defined as aforementioned.

Figure 13:
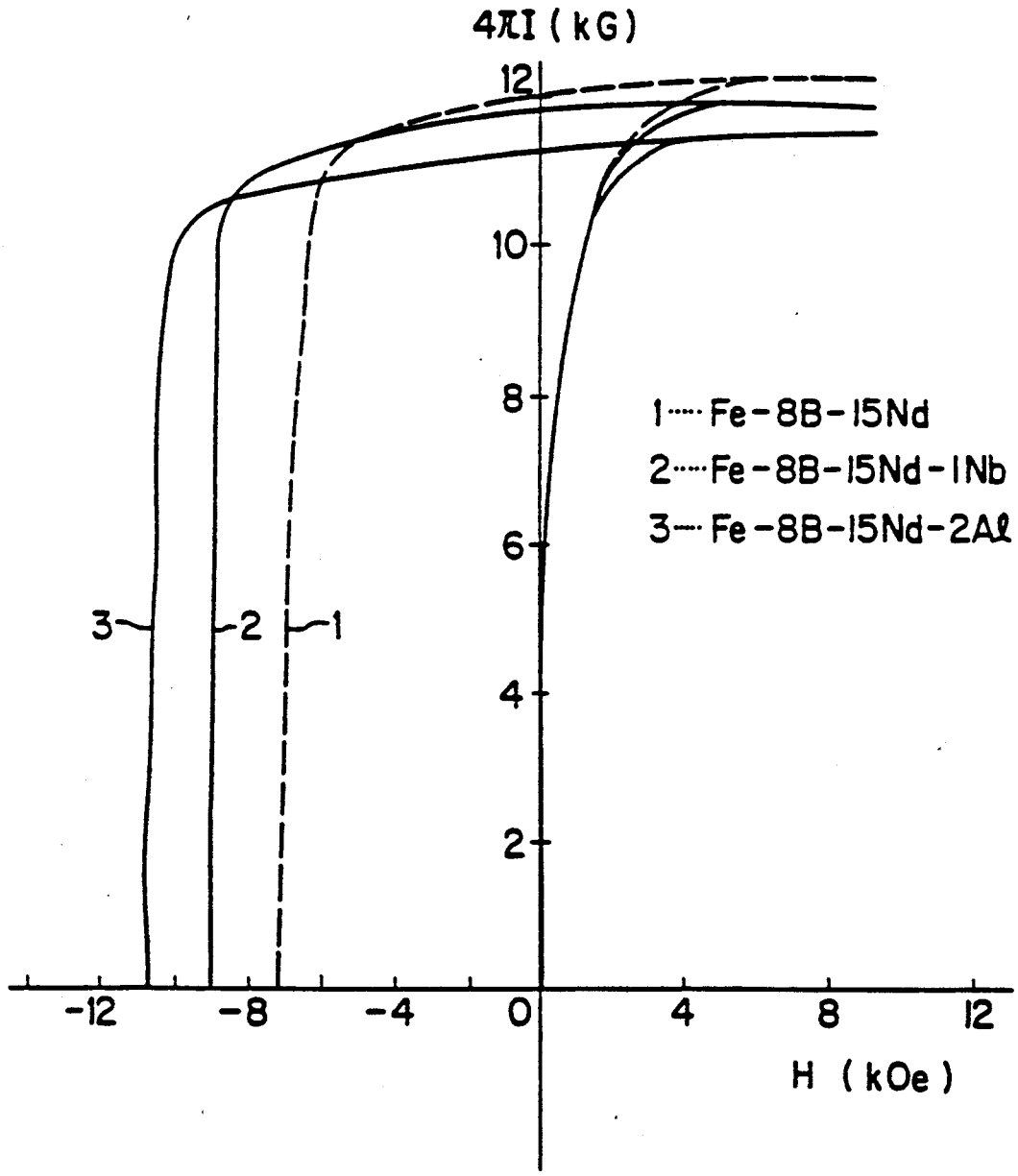
FIG. 13 is a graph showing magnetization-demagnetization curves for typical embodiments of the present invention.

As apparent from FIGS. 10 to 12, in most cases, the greater the amounts of the additional elements M, the lower the Br resulting in the lower (BH)max, as illustrated in Table 5. However, increases in iHc are vital for such permanent magnets as to be exposed to a very high reversed magnetic field or severe environmental conditions such as high temperature, and provide technical advantages as well as in the case of those with the high (BH)max type. Typically, FIG. 13 illustrates three initial magnetization curves and demagnetization curves 1–3 of (1) Fe-8B-15Nd, (2) Fe-8B-15Nd-1Nb, and (3) Fe-8B-15Nd-2Al.

Samples 1, 2 and 3 (curves 1, 2 and 3) were obtained based on the samples identical with sample No. 1 (Table 6), sample No. 5 and sample No. 21 (Table 5), respectively. The curves 2 and 3 also show the rectangularity or loop squareness in the second quadrant useful for permanent magnets.

In Table 5, for samples Nos. 37–42, 51 and 52 Pr as R was used, samples Nos. 48–50 were based on Fe-12B-20Nd-1M, and samples Nos. 51 and 52 based on Fe-12B-20Pr-1M. Samples Nos. 40, 42–47, 53–58 and 60–65 indicate that even the addition of two or more elements M gives good results.

Increased iHc of samples Nos. 5 and 6 of Table 6 are due to high Nd contents. However, the effect of M addition is apparent from samples 48–50, 53–55, 63 and 64, respectively.

Samples No. 56 shows iHc of 4.3 kOe, which is higher than 2.8 kOe of *16, and sample No. 59 shows iHc of 7.3 kOe which is higher than 5.1 kOe of No. 7. Thus, the addition of M is effective on both samples.

As samples Nos. 1 and 4, it is also possible to obtain a high coercive force while maintaining a high (BH)max.

The Fe-B-R-M base permanent magnets may contain, in addition to Fe, B, R and M, impurities which are entrained in the process of industrial production.

TABLE 5-1

| No. | Composition in atomic percent | iHc (kOe) | Br (kG) | (BH)max (MGOe) |
|---|---|---|---|---|
| 1 | Fe—8B—15Nd—1Ti | 9.0 | 12.3 | 35.1 |
| 2 | Fe—8B—15Nd—1V | 8.1 | 11.5 | 30.0 |
| 3 | Fe—8B—15Nd—5V | 8.3 | 9.2 | 15.5 |
| 4 | Fe—8B—15Nd—0.5Nb | 8.5 | 12.4 | 35.7 |
| 5 | Fe—8B—15Nd—1Nb | 9.1 | 11.9 | 32.9 |
| 6 | Fe—8B—15Nd—5Nb | 10.2 | 10.5 | 25.9 |
| 7 | Fe—8B—15Nd—0.5Ta | 9.0 | 11.7 | 31.5 |
| 8 | Fe—8B—15Nd—1Ta | 9.2 | 11.6 | 30.7 |
| 9 | Fe—8B—15Nd—0.5Cr | 9.5 | 11.4 | 30.0 |
| 10 | Fe—8B—15Nd—1Cr | 9.9 | 11.3 | 29.9 |
| 11 | Fe—8B—15Nd—5Cr | 10.4 | 8.6 | 17.4 |
| 12 | Fe—8B—15Nd—0.5Mo | 8.0 | 11.6 | 30.5 |
| 13 | Fe—8B—15Nd—1Mo | 8.1 | 11.7 | 31.0 |
| 14 | Fe—8B—15Nd—5Mo | 9.9 | 9.2 | 18.9 |
| 15 | Fe—8B—15Nd—0.5W | 9.4 | 11.8 | 32.9 |
| 16 | Fe—8B—15Nd—1Mn | 8.0 | 10.6 | 25.3 |
| 17 | Fe—8B—15Nd—3Mn | 7.6 | 9.5 | 19.7 |
| 18 | Fe—8B—15Nd—0.5Ni | 8.1 | 11.8 | 29.5 |
| 19 | Fe—8B—15Nd—4Ni | 7.4 | 11.2 | 20.5 |
| 20 | Fe—8B—15Nd—0.5Al | 9.3 | 12.0 | 33.0 |

TABLE 5-2

| No. | Composition in atomic percent | iHc (kOe) | Br (kG) | (BH)max (MGOe) |
|---|---|---|---|---|
| 21 | Fe—8B—15Nd—2Al | 10.7 | 11.3 | 29.0 |
| 22 | Fe—8B—15Nd—5Al | 11.2 | 9.0 | 19.2 |
| 23 | Fe—8B—15Nd—0.5Ge | 8.1 | 11.3 | 25.3 |
| 24 | Fe—8B—15Nd—1Sn | 14.2 | 9.8 | 20.1 |
| 25 | Fe—8B—15Nd—1Sb | 10.5 | 9.1 | 15.2 |
| 26 | Fe—8B—15Nd—1Bi | 11.0 | 11.8 | 31.8 |
| 27 | Fe—17B—15Nd—3.5Ti | 8.9 | 9.7 | 20.8 |
| 28 | Fe—17B—15Nd—1Mo | 9.5 | 8.5 | 16.4 |
| 29 | Fe—17B—15Nd—5Mo | 13.1 | 7.8 | 14.4 |
| 30 | Fe—17B—15Nd—2Al | 12.3 | 7.9 | 14.3 |

TABLE 5-2-continued

| No. | Composition in atomic percent | iHc (kOe) | Br (kG) | (BH)max (MGOe) |
|---|---|---|---|---|
| 31 | Fe—17B—15Nd—5Al | >15 | 6.5 | 10.2 |
| 32 | Fe—17B—15Nd—1.5Zr | 11.3 | 8.4 | 16.5 |
| 33 | Fe—17B—15Nd—4Zr | 13.6 | 7.8 | 14.5 |
| 34 | Fe—17B—15Nd—0.5Hf | 8.9 | 8.6 | 17.6 |
| 35 | Fe—17B—15Nd—4Hf | 13.6 | 7.9 | 14.6 |
| 36 | Fe—17B—15Nd—6V | >15 | 7.4 | 12.8 |
| 37 | Fe—8B—15Pr—3Al | 9.6 | 9.8 | 20.2 |
| 38 | Fe—8B—15Pr—2Mo | 8.1 | 9.8 | 20.3 |
| 39 | Fe—14B—15Pr—2Zr | 10.3 | 6.9 | 10.9 |
| 40 | Fe—17B—15Pr—1Hf—1Al | 9.2 | 6.8 | 10.2 |

TABLE 5-3

| No. | Composition in atomic percent | iHc (kOe) | Br (kG) | (BH)max (MGOe) |
|---|---|---|---|---|
| 41 | Fe—15B—15Pr—3Nb | 10.1 | 6.9 | 10.8 |
| 42 | Fe—16B—15Pr—0.5W—1Cr | 10.3 | 6.7 | 10.2 |
| 43 | Fe—8B—14Nd—1Al—2W | 10.0 | 10.7 | 24.7 |
| 44 | Fe—6B—16Nd—1Mo—0.5Ta | 8.6 | 10.5 | 23.7 |
| 45 | Fe—8B—10Nd—5Pr—2Nb—3V | 11.6 | 9.4 | 20.2 |
| 46 | Fe—8B—10Nd—5Ce—0.5Hf—2Cr | 8.5 | 9.0 | 19.3 |
| 47 | Fe—12B—15Pr—5Nd—2Zr—1Al | 10.1 | 8.7 | 15.1 |
| 48 | Fe—12B—20Nd—1Al | 14.1 | 8.1 | 14.4 |
| 49 | Fe—12B—20Nd—1W | 14.2 | 7.9 | 14.5 |
| 50 | Fe—12B—20Nd—1Nb | 13.9 | 8.2 | 14.3 |
| 51 | Fe—12B—20Pr—1Cr | 13.4 | 7.0 | 11.2 |
| 52 | Fe—12B—20Pr—1Bi | 14.1 | 7.3 | 11.6 |
| 53 | Fe—8B—20Nd—0.5Nb—0.5Mo—1W | >15 | 7.3 | 11.5 |
| 54 | Fe—8B—20Nd—1Ta—0.5Ti—2V | >15 | 7.4 | 11.7 |
| 55 | Fe—8B—20Nd—1Mn—1Cr—1Al | >15 | 7.0 | 10.9 |
| 56 | Fe—4B—15Nd—0.5Mo—0.5W | 4.3 | 10.8 | 20.7 |
| 57 | Fe—18B—14Nd—0.5Cr—0.5Nb | 8.5 | 7.9 | 14.3 |
| 58 | Fe—17B—13Nd—0.5Al—1Ta | 8.0 | 8.2 | 14.7 |
| 59 | Fe—8B—10Nd—5Ce—2V | 7.3 | 9.5 | 20.0 |
| 60 | Fe—8B—10Nd—5Tb—1Sn—0.5W | 9.3 | 8.4 | 15.7 |

TABLE 5-4

| No. | Composition in atomic percent | iHc iHc (kOe) | Br Br (kG) | (BH)max (BH)max (MGOe) |
|---|---|---|---|---|
| 61 | Fe—8B—10Nd—5Dy—0.5Ge—1Al | 8.9 | 8.3 | 15.2 |
| 62 | Fe—8B—13Nd—2Sm—0.5Nb—0.5Ti | 8.5 | 8.9 | 15.4 |
| 63 | Fe—8B—25Nd—1Mo—0.3Ti | >15 | 7.1 | 11.0 |
| 64 | Fe—8B—25Nd—1V—0.3Nb | >15 | 7.1 | 10.9 |
| 65 | Fe—8B—25Pr—1Ni—0.3W | >15 | 6.7 | 10.3 |

TABLE 6

| No. | Composition in atomic percent | iHc (kOe) | Br (kG) | (BH)max (MGOe) |
|---|---|---|---|---|
| 1 | Fe—8B—15Nd | 7.3 | 12.1 | 32.1 |
| 2 | Fe—8B—15Pr | 6.6 | 11.0 | 26.5 |
| 3 | Fe—17B—15Nd | 7.6 | 8.7 | 17.6 |
| 4 | Fe—17B—15Pr | 7.2 | 7.9 | 14.8 |
| 5 | Fe—12B—20Nd | 12.4 | 8.5 | 15.1 |
| 6 | Fe—12B—25Nd | 13.9 | 6.8 | 9.4 |
| 7 | Fe—8B—10Nd—5Ce | 5.1 | 9.8 | 17.8 |
| *8 | Fe—15Nd—5Al | <1 | <1 | <1 |
| *9 | Fe—15Pr—3W | <1 | <1 | <1 |
| *10 | Fe—15Pr—2Nb | <1 | <1 | <1 |
| *11 | Fe—15Pr—2Cr | <1 | <1 | <1 |
| *12 | Fe—19B—5Nd—2W | <1 | <1 | <1 |
| *13 | Fe—19B—5Nd—3V | <1 | <1 | <1 |
| *14 | Fe—30B—15Nd—5Al | <1 | <1 | <1 |
| *15 | Fe—8B—35Nd—5Cr | >15 | <1 | <1 |
| 16 | Fe—4B—15Nd | 2.8 | 10.8 | 13.4 |

CRYSTAL GRAIN SIZE (Fe-B-R-M system)

Pulverization in the experimental procedures as aforementioned was carried out for varied periods of time selected in such a manner that the measured average particle sizes of the powder ranges from 0.5 to 100 μm, as measured with a sub-sieve-sizer manufactured by Fisher. In this manner, various samples having the compositions as specified in Tables 7 and 8 were obtained.

COMPARATIVE EXAMPLES

To obtain a crystal grain size of 100 μm or greater, the sintered bodies were maintained for prolonged time in an argon atmosphere at a temperature lower than the sintered temperature by 5°-20° C. (Table 7, No. *11).

From the thus prepared samples having the compositions as specified in Table 7 and 8 were obtained magnets which were studied to determine their magnetic properties and the mean crystal grain sizes. The results are set forth in Tables 7 and 8. The measurements of the mean crystal grain size were done substantially in the same manner as for the Fe-B-R system aforementioned.

In Table 7, the samples marked * represent comparative examples. Nos. *1-*4, *6 and *8-*10 depart from the scope of the composition of the magnets according to the present invention. Nos. *5, *7, *11 and *12 have the mean crystal grain size outside of the present invention.

From Nos. *11 and *12, it is found that Hc drops to less 1 kOe when the crystal grain size departs from the scope as defined in the present invention.

Samples having the same composition as Nos. 9 and 21 given in Table 8 were studied in detail in respect of the relationship between their means crystal grain size D and Hc. The results are illustrated in FIG. 6, from which it is found that Hc peaks when D is approximately in a range of 3-10 μm, decreases steeply when D is below that range, and drops moderately when D is above that range. Even when the composition varies within the scope as defined in the present invention, the relationship between the mean crystal grain size D and Hc is substantially maintained. This indicates that the Fe-B-R-M system magnets are the single domain fine particle type magnets as in the case of the Fe-B-R system.

TABLE 7

| No. | Composition | Mean crystal grain size D (μm) | Magnetic Properties iHc (kOe) | Br (kG) | (BH)max MGOe |
|---|---|---|---|---|---|
| *1 | 80Fe—20Nd | 15 | 0 | 0 | 0 |
| *2 | 53Fe—32B—15Nd | 7 | 10.2 | 3.0 | 1.8 |
| *3 | 48Fe—17B—35Nd | 4 | >15 | 1.4 | <1 |
| *4 | 73Fe—10B—17Nd | 0.4 | <1 | 5.0 | <1 |
| *5 | 82Fe—5B—13Nd | 140 | <1 | 6.3 | 2.0 |
| *6 | 78Fe—17B—5Pr | 3.5 | 0 | 0 | 0 |
| *7 | 74Fe—11B—7Sm—8Pr | 93 | <1 | 4.8 | <1 |
| *8 | 74Fe—19B—5Nd—2W | 8.8 | <1 | <1 | 1 |
| *9 | 83Fe—15Pr—2Nd | 33 | <1 | <1 | <1 |
| *10 | 51Fe—6B—35Nd—8Cr | 12.1 | <1 | <1 | <1 |
| *11 | 76Fe—8B—15Nd—1Mn | 105 | <1 | 3.2 | <1 |
| *12 | 74Fe—8B—15Nd—3Cr | 0.3 | <1 | <1 | <1 |

TABLE 8-1

| No. | Composition | Mean crystal grain size D (μm) | Magnetic Properties iHc (kOe) | Br (kG) | (BH)max MGOe |
|---|---|---|---|---|---|
| 1 | Fe—8B—15Nd—1Ti | 5.6 | 9.0 | 12.6 | 36.5 |
| 2 | Fe—8B—15Nd—1V | 3.5 | 9.0 | 11.0 | 26.8 |
| 3 | Fe—8B—15Nd—2Nb | 7.8 | 9.4 | 11.7 | 30.4 |
| 4 | Fe—8B—15Nd—1Ta | 10.2 | 8.6 | 11.6 | 28.0 |
| 5 | Fe—8B—15Nd—2Cr | 4.8 | 9.9 | 11.2 | 29.6 |
| 6 | Fe—8B—15Nd—0.5Mo | 5.6 | 8.4 | 12.0 | 33.1 |
| 7 | Fe—8B—15Nd—1Mo | 4.9 | 8.3 | 11.7 | 30.8 |
| 8 | Fe—8B—15Nd—5Mo | 8.5 | 8.8 | 9.0 | 17.5 |
| 9 | Fe—8B—15Nd—1W | 6.3 | 9.6 | 12.1 | 33.6 |
| 10 | Fe—8B—15Nd—1Nb | 6.6 | 9.6 | 12.3 | 35.3 |
| 11 | Fe—8B—15Nd—1Mn | 8.2 | 8.0 | 10.6 | 25.3 |
| 12 | Fe—8B—15Nd—1Mn | 20.2 | 6.8 | 10.2 | 18.4 |
| 13 | Fe—8B—15Nd—2Ni | 12.0 | 7.3 | 11.4 | 22.7 |
| 14 | Fe—8B—15Nd—1Al | 9.6 | 9.9 | 11.2 | 29.0 |
| 15 | Fe—8B—15Nd—0.5Ge | 4.6 | 8.1 | 11.3 | 25.3 |
| 16 | Fe—8B—15Nd—1Sn | 6.4 | 14.2 | 9.8 | 20.1 |
| 17 | Fe—8B—15Nd—1Sb | 7.7 | 10.5 | 9.1 | 15.2 |
| 18 | Fe—8B—15Nd—1Bi | 5.1 | 11.0 | 11.8 | 31.8 |
| 19 | Fe—14B—15Nd—2Zr | 8.9 | 10.8 | 8.2 | 16.3 |
| 20 | Fe—14B—15Nd—4Hf | 9.5 | 11.4 | 7.7 | 13.3 |

TABLE 8-2

| No. | Composition | Mean crystal grain size D (μm) | Magnetic Properties iHc (kOe) | Br (kG) | (BH)max MGOe |
|---|---|---|---|---|---|
| 21 | Fe—8B—15Nd—5Al | 4.4 | 11.2 | 9.3 | 20.0 |
| 22 | Fe—15B—15Pr—3Nb | 2.2 | 10.1 | 7.4 | 11.6 |
| 23 | Fe—10B—14Nd—1Al—2W | 6.5 | 10.8 | 10.6 | 24.4 |
| 24 | Fe—8B—10Nd—5Pr—2Nb—2Ge | 7.1 | 11.2 | 9.6 | 21.2 |
| 25 | Fe—8B—20Nd—1Ti—1Nb—1Cr | 4.4 | >15 | 7.1 | 10.8 |
| 26 | Fe—8B—20Nd—1Ta—1Hf—1W | 5.9 | >15 | 7.0 | 11.3 |
| 27 | Fe—8B—10Nd—5Ho—1Al—1Nb | 8.5 | 13.3 | 9.2 | 20.2 |

TABLE 8-2-continued

| No. | Composition | Mean crystal grain size D (μm) | Magnetic Properties iHc (kOe) | Br (kG) | (BH)max MGOe |
|---|---|---|---|---|---|
| 28 | Fe—8B—20Pr—1Ti—1Mn | 6.8 | 14.0 | 6.8 | 9.8 |
| 29 | Fe—8B—25Nd—1Mo—1Zr | 3.6 | >15 | 6.6 | 9.2 |
| 30 | Fe—17B—15Pr—1Nb—1V | 7.8 | 9.6 | 7.0 | 10.4 |
| 31 | Fe—10B—13Nd—2Dy—1La | 8.8 | 7.4 | 10.2 | 21.8 |
| 32 | Fe—9B—10Nd—5Pr—1Sn—0.5Gd | 6.3 | 7.2 | 9.4 | 18.2 |
| 33 | Fe—9B—16Nd—1Ce | 13.7 | 6.8 | 9.1 | 16.6 |

From the results given in Tables 7 and 8 and FIG. 6, it is apparent that, in order for the Fe-B-R-M system magnets to possess Br of about 4 kG of hard ferrite or more and Hc of no less than 1 kOe, the composition comes within the range as defind in the present embodiment and the mean crystal grain size is 1-90 μm, and that, in order to obtain Hc of no less than 4 kOe, the mean crystal grain size should be in a range of 2-40 μm.

The three curves shown in FIG. 13 for the magnetization and demagnetization were obtained based on the mean crystal grain size of 5-10 μm.

The Fe-B-R-M system magnetic materials and permanent magnets have basically the same crystal structure as the Fe-B-R system as shown in Table 4, Nos. 13-21, and permit substantially the same impurities as in the case of the Fe-B-R system (see Table 10).

For the purpose of comparison, Table 9 shows the magnetic and physical properties of the typical example according to the present invention and the prior art permanent magnets.

Accordingly, the present invention provides Co-free, Fe base inexpensive alloys, magnetic materials having high magnetic properties, and sintered, magnetic anisotropic permanent magnets having high remanence, high coercive force, high energy product and high mechanical strength, and thus present a technical breakthrough.

It should be understood that the present invention is not limited to the disclosure of the experiments examples and embodiments herein-aforementioned and any modifications apparent in the art may be done without departing from the concept and claims as set forth hereinbelow.

TABLE 9

| | Magnetic Properties: Residual magnetic flux density Br KG | Coercive force bHc kOe | Coercive force iHc kOe | Maximum energy product (BH)max MGOe | Physical Properties: Specific gravity g/cm³ | Resistivity μΩ · cm | Hardness Hv | Bending strength kg/mm² |
|---|---|---|---|---|---|---|---|---|
| FeBR magnet Fe-8B-14Nd | 12.5 | 10.9 | 11.1 | 36.0 | 7.4 | 144 | 600 | 25 |
| Rare earth cobalt magnet $Sm_2Co_{17}$ | 11.2 | 6.7 | 6.9 | 31.0 | 8.4 | 85 | 550 | 12 |
| Ferrite magnet $SrO.6Fe_2O_3$ | 4.4 | 2.8 | 2.9 | 4.6 | 5.0 | $>10^4$ | 530 | 13 |

TABLE 10

| | | iHc (kOe) | Br (kG) | (BH)max (MGOe) |
|---|---|---|---|---|
| 1 | Fe—8B—15Nd—2Cu | 2.6 | 9.2 | 8.2 |
| 2 | Fe—8B—15Nd—1S | 6.4 | 7.1 | 11.0 |
| 3 | Fe—8B—15Nd—1C | 6.6 | 11.7 | 21.9 |
| 4 | Fe—8B—15Nd—5Ca | 9.3 | 11.6 | 25.8 |
| 5 | Fe—8B—15Nd—5Mg | 7.8 | 11.5 | 22.6 |
| 6 | Fe—8B—15Nd—5Si | 6.8 | 10.6 | 25.2 |
| 7 | Fe—8B—15Nd—0.70 | 8.0 | 11.6 | 30.1 |
| 8 | Fe—8B—15Nd—1.5P | 10.6 | 9.4 | 19.7 |

TABLE 10-continued

| | | iHc (kOe) | Br (kG) | (BH)max (MGOe) |
|---|---|---|---|---|
| 9 | Fe—8B—15Nd—2W—2Mg | 8.5 | 10.8 | 21.8 |
| 10 | Fe—8B—15Nd—1Nb—1Cu | 5.5 | 10.9 | 16.7 |

We claim:

1. A crystalline permanent magnet alloy in which the major phase is an Fe-B-R compound wherein R is one or two of Nd and Pr, said compound being stable at room temperature or above, having a Curie temperature higher than room temperature and having magnetic anisotropy, the alloy consisting essentially of, by atomic percent of the entire alloy, 8-30 percent R, 2-28 percent B and the balance being at least 42 percent Fe.

2. A crystalline permanent magnet alloy comprising a major phase of an Fe-B-R compoud wherein R is at least one of Nd, Pr, Dy, Ho, Tb, La, Ce, Gd and Y, and wherein at least 50 atomic percent of R consists of Nd and/or Pr, said compound being stable at room temperature or above, having a Curie temperature higher than room temperature and having magnetic anisotropy, the alloy consisting essentially of, by atomic percent of the entire alloy, 8-30 percent R, 2-28 percent B and the balance being at least 42 percent Fe.

3. The permanent magnet alloy as defined in claim 1 or 2 which is polycrystalline.

4. The permanent magnet alloy as defined in claim 1 or 2, wherein said compound is stable after heating at least about 1000° C.

5. The permanent magnet alloy as defined in claim 4, wherein said compound is stable such that the alloy can be powder metallurgically sintered.

6. The permanent magnet alloy as defined in claim 1 or 2, wherein said compound has a Curie temperature of about 300° C. or more.

7. The permanent magnet alloy as defined in claim 1 or 2, which has a coercive force of at least 1 kOe at room temperature in a powder state.

8. The permanent magnet alloy as defined in claim 1 or 2, which has a maximum energy product of at least 4

MGOe upon sintering through a powder metallurgical process.

9. The permanent magnet alloy as defined in claim 1 or 2, wherein the alloy consists essentially of, by atomic percent of the alloy, 12–24% R, 4–24% B and at least 52% Fe.

10. The permanent magnet alloy as defined in claim 9, wherein said alloy has a maximum energy product of at least 10 MGOe upon sintering through a powder metallurgical process.

11. The permanent magnet alloy as defined in claim 10, wherein said alloy has a maximum energy product of at least 20 MGOe upon sintering.

12. The permanent magnet alloy as defined in claim 1 or 2, wherein a minor amount of at least one element selected from the group consisting of Al, Ti, V, Cr, Mn, Zr, Nb, Mo, Ta, W, Sn, Bi, Sb, Si, and Ni is added to the alloy, provided that at least 8 percent R, at least 2 percent B and at least 42 percent Fe are present in the resultant alloy.

13. The permanent magnet alloy as defined in claim 1 or 2, wherein said compound has a tetragonal crystal structure.

14. The permanent magnet alloy as defined in claim 1 or 2, which contains no less than 1 vol % and less than 50 vol % of a nonmagnetic phase in the entire alloy.

15. A permanent magnet comprising the alloy as defined in claim 1 or 2.

16. The permanent magnet as defined in claim 15, wherein said compound occupies at least 50 vol % of the entire magnet.

17. A permanent magnet as defined in claim 15, which is anisotropic.

18. A crystalline permanent magnet alloy comprising a major phase of an Fe-B-R compound wherein R is at least one selected from the group consisting of Nd, Pr, La, Ce, Tb, Dy, Ho, Er, Eu, Sm, Gd, Pm, Tm, Yb, Lu and Y, said Fe-B-R compound being stable at room temperature or above, having a Curie temperature higher than room temperature and having magnetic anisotropy, and the alloy consisting essentially of, by atomic percent of the entire alloy, 8–30 percent R, 2–28 percent B and the balance being Fe, provided that at least 42 percent of the entire alloy is Fe.

19. The permanent magnet alloy as defined in claim 18, wherein R is at least one selected from the group consisting of Nd, Pr, Dy, Ho, Tb, La, Ce, Gd and Y.

20. The permanent magnet alloy as defined in claim 18, wherein said compound is stable after heating to at least about 1000° C.

21. The permanent magnet alloy as defined in claim 20, wherein said Fe-B-R compound is stable such that the alloy can be powder metallurgically sintered.

22. The permanent magnet alloy as defined in claim 18, wherein said major phase has a Curie temperature higher than about 300° C.

23. The permanent magnet alloy as defined in claim 18, which has an intrinsic coercivity of at least 1 kOe at room temperature in a powder state.

24. The permanent magnet alloy as defined in claim 18, which has a maximum energy product of at least 4 MGOe upon sintering through a powder metallurgical process.

25. The permanent magnet alloy as defined in claim 18, wherein the alloy consists essentially of, by atomic percent of the entire alloy, 12–24 percent R, 4–24 percent B and the balance being Fe, provided that at least 52 percent of the entire alloy is Fe.

26. The permanent magnet alloy as defined in claim 25, wherein said alloy has a maximum energy product of at least 10 MGOe upon sintering through a powder metallurgical process.

27. The permanent magnet alloy as defined in claim 25, wherein said alloy has maximum energy product of at least 20 MGOe upon sintering.

28. The permanent magnet alloy as defined in claim 18, wherein a minor amount of at least one element selected from the group consisting of Al, Ti, V, Cu, Cr, Mn, Zr, Nb, Mo, Ta, W, Sn, Bi, Sb, Si and Ni is added to the alloy, provided that at least 8 percent R, at least 2 percent B and at least 42 percent Fe are present in the resultant alloy.

29. The permanent magnet alloy as defined in claim 18, wherein said Fe-B-R compound has a tetragonal crystal structure.

30. The permanent magnet alloy as defined in claim 18, wherein said Fe-B-R compound occupies at least 90 vol % of the entire alloy.

31. The permanent magnet alloy as defined in claim 28, wherein the total amount of said added element or elements is present in an amount of no more than 12.5 atomic percent in the alloy.

32. The permanent magnet alloy as defined in claim 18, wherein at least one additional element M is added to the alloy, M being selected from the group given below in the amounts of no more than the atomic percentages specified below, and wherein when more than one element comprises M, the sum of M is no more than the maximum value of any one of the values specified below for M actually added, provided that at least 8 percent R, at least 2 percent B and at least 42 percent Fe are present in the resultant alloy:

| | | |
|---|---|---|
| 4.5% Ti, | 8.0% Ni, | 5.0% Bi, |
| 9.5% V, | 12.5% Nb, | 10.5% Ta, |
| 8.5% Cr, | 9.5% Mo, | 9.5% W, |
| 8.0% Mn, | 9.5% Al, | 2.5% Sb, |
| 7.0% Ge, | 3.5% Sn, | 5.5% Zr, |
| and 5.5% Hf. | | |

33. The permanent magnet alloy as defined in claim 18, wherein Si is present in an amount of no more than 5 atomic percent of the entire alloy, provided that at least 42 atomic percent of the entire alloy is Fe.

34. The permanent magnet alloy as defined in claim 25, wherein R is about 15 atomic percent.

35. The permanent magnet alloy as defined in claim 34, wherein B is about 8 atomic percent.

36. A permanent magnet comprising the alloy as defined in claim 33, which has an energy product of at least 4 MGOe.

37. The permanent magnet comprising a shaped body including the alloy as defined in claim 24 and having an energy product of 10 MGOe or more.

38. The permanent magnet as defined in claim 37, which has an energy product of 20 MGOe or more.

39. The permanent magnet as defined in claim 37 or 38, which is magnetically anisotropic.

40. A crystalline permanent magnet comprising a major phase of an Fe-B-R compound wherein R is at least one selected from the group consisting of Nd, Pr, La, Ce, Tb, Dy, Ho, Er, Eu, Sm, Gd, Pm, Tm, Yb, Lu and Y, said Fe-B-R compound being stable at room temperature or above, having a Curie temperature higher than room temperature and having magnetic anisotropy, and the alloy consisting essentially of, by atomic percent of the entire alloy, 8–30 percent R, 2–28 percent B and the balance being Fe, provided that at least 42 percent of the entire alloy is Fe.

41. The permanent magnet alloy as defined in claim 40, wherein said R is at least one selected from the group consisting of Nd, Pr, Dy, Ho, Tb, La, Ce, Gd and Y.

42. The permanent magnet as defined in claim 40, which is formed into a shaped body.

43. The permanent magnet as defined in claim 42, which is a sintered body.

44. The permanent magnet as defined in claim 40, which is magnetically anisotropic.

45. The permanent magnet as defined in claim 40, wherein said Fe-B-R compound occupies at least 50 vol % of the entire magnet.

46. The permanent magnet as defined in claim 42, wherein said Fe-B-R compound occupies at least 90 vol % of the entire magnet.

47. The permanent magnet as defined in claim 40, which has a maximum energy product of at least 4 MGOe.

48. The permanent magnet as defined in claim 41, wherein the magnet consists essentially of, by atomic percent of the entire magnet, 12–24 percent R, 4–24 percent B and the balance being Fe, provided that at least 52 percent of the entire magnet is Fe and the magnet has an energy product of 10 MGOe or more.

49. The permanent magnet as defined in claim 48, which has an energy product of 20 MGOe or more.

50. The permanent magnet as defined in claim 48, which is a sintered body.

51. The permanent magnet as defined in claim 48, which is magnetically anisotropic.

52. The permanent magnet as defined in claim 51, which has an energy product of 30 MGOe or more.

53. The permanent magnet as defined in claim 51, which has an energy product of 33 MGOe or more.

54. The permanent magnet as defined in claim 40, wherein said Fe-B-R compound has a tetragonal crystal structure.

55. The permanent magnet as defined in claim 40, wherein R is about 15 atomic percent.

56. The permanent magnet as defined in claim 55, wherein B is about 8 atomic percent.

57. The permanent magnet as defined in claim 40, in which initial magnetization is determined by nucleation.

58. The permanent magnet as defined in claim 40, wherein a minor amount of at least one element selected from the group consisting of Al, Ti, V, Cr, Mn, Cu, Zr, Nb, Mo, Ta, W, Sn, Bi, Sb, Si and Ni is added to the magnet, provided that at least 8 percent R, at least 2 percent B and at least 42 percent Fe are present in the resultant magnet.

59. The permanent magnet as defined in claim 40, wherein at least one additional element M is added to the magnet, M being selected from the group given below in the amounts of no more than the atomic percentages specified below, and wherein when more than one element comprises M, the sum of M is no more than the maximum value of any one of the values specified below for M actually added, provided that at least 8 percent R, at least 2 percent B and at least 42 percent Fe are present in the resultant magnet:

| | | |
|---|---|---|
| 4.5% Ti, | 8.0% Ni, | 5.0% Bi, |
| 9.5% V, | 12.5% Nb, | 10.5% Ta, |
| 8.5% Cr, | 9.5% Mo, | 9.5% W, |
| 8.0% Mn, | 9.5% Al, | 2.5% Sb, |
| 7.0% Ge, | 3.5% Sn, | 5.5% Zr, |
| and 5.5% Hf. | | |

60. The permanent magnet as defined in claim 40, wherein Si is present in an amount of no more than 5 atomic percent of the entire magnet provided that Fe is present at least 42 atomic percent.

61. The permanent magnet as defined in claim 40, wherein the Fe-B-R compound has a mean crystal grain size of at least 1 micron.

62. The permanent magnet as defined in claim 40, which has a demagnetization curve which is substantially rectangular in the second quadrant.

63. The permanent magnet as defined in claim 60, wherein at least 50 atomic percent of R consists of Nd and/or Pr.

* * * * *